US009141022B2

(12) United States Patent
Kobayashi

(10) Patent No.: US 9,141,022 B2
(45) Date of Patent: Sep. 22, 2015

(54) IMAGE FORMING APPARATUS HAVING AN IMAGE FORMING UNIT ARRANGED DETACHABLY TO AN APPARATUS BODY AND HAVING AN IMAGE CARRIER, AN EXPOSURE DEVICE, ARRANGED IN THE APPARATUS BODY, FOR EXPOSING THE IMAGE CARRIER, AND A CLEANER FOR CLEANING THE EXPOSURE DEVICE

(71) Applicant: Oki Data Corporation, Tokyo (JP)

(72) Inventor: Atsushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/288,784

(22) Filed: May 28, 2014

(65) Prior Publication Data

US 2014/0356017 A1 Dec. 4, 2014

(30) Foreign Application Priority Data

May 30, 2013 (JP) ..... 2013-114040

(51) Int. Cl.
*G03G 15/04* (2006.01)
*G03G 21/00* (2006.01)

(52) U.S. Cl.
CPC ..... *G03G 15/04* (2013.01)

(58) Field of Classification Search
CPC ..... G03G 15/04; G03G 21/185; G03G 2221/1815
USPC ..... 399/98, 99, 110, 111
See application file for complete search history.

(56) References Cited

U.S. PATENT DOCUMENTS 8,203,586 B2 * 6/2012 Kaneko et al. ..... 399/98
2013/0308977 A1 * 11/2013 Fujii ..... 399/111

FOREIGN PATENT DOCUMENTS

JP 2011-088384 A 5/2011

* cited by examiner

*Primary Examiner* — Sophia S Chen
(74) *Attorney, Agent, or Firm* — Panitch Schwarze Belisario & Nadel LLP

(57) ABSTRACT

An image forming apparatus includes an image forming unit, a unit supporting member for supporting the image forming unit, and an exposure device, wherein the unit supporting member includes a first contact supporting portion for supporting the image forming unit, and a second contact supporting portion disposed on a downstream side of the first contact supporting portion in a taking out direction of the image forming unit with a step portion. The image forming unit includes a first contact supported portion contacting and being supported by the first contact supporting portion, a second contact supported portion contacting and being supported by the second contact supporting portion, and a cleaner for cleaning the exposure device. Because the cleaner cleans the exposure device when the image forming unit is taken out from the unit supporting member, light from the exposure device is surely radiated to an image carrier surface.

15 Claims, 25 Drawing Sheets

IMAGE FORMING APPARATUS HAVING AN IMAGE FORMING UNIT ARRANGED DETACHABLY TO AN APPARATUS BODY AND HAVING AN IMAGE CARRIER, AN EXPOSURE DEVICE, ARRANGED IN THE APPARATUS BODY, FOR EXPOSING THE IMAGE CARRIER, AND A CLEANER FOR CLEANING THE EXPOSURE DEVICE

CROSS REFERENCE TO RELATED APPLICATION

This application claims priority benefits under 35 USC, section 119 on the basis of Japanese Patent Application No. 2013-114040, the disclosure of which is incorporated herein by reference.

BACKGROUND OF THE INVENTION

1. Field of the Invention

This invention relates to an image forming apparatus.

2. Background of Related Art

Image forming apparatuses such as printers, facsimile machines, and photocopiers, inter alia printers, in prior art are provided with such as, e.g., image forming units, LED (Light Emitting Diode) heads serving as exposure devices, transfer rollers, fixing devices, and paper cassettes. The image forming units are disposed detachably to the printer body or the apparatus body, being equipped with such as, e.g., photosensitive drums, charge rollers, developing rollers, developing blades, toner supply rollers, cleaning blades, and toner cartridges. Toners are contained in the toner cartridges, respectively, and paper is contained in the respective paper cassettes.

In such an image forming unit, the LED head exposes a surface of the photosensitive drum charged uniformly with the charge roller to form electrostatic latent images. The toner supplied in the image forming unit body from the toner cartridge is further supplied to the developing roller with a toner supply roller, thereby forming a thin toner layer on the developing roller by the developing blade. The toner on the developing roller is attached to the electrostatic latent images on the photosensitive drums to form toner images on the photosensitive drums by developing the electrostatic latent images.

The paper fed out from the paper cassette is conveyed between the photosensitive drum and the transfer roller, and the toner image is transferred onto the paper with the transfer roller. The paper is fed to the fixing device, and the toner image is fixed to the paper at the fixing device. The images are thus formed, and the paper subject to printing is ejected from the apparatus body.

The LED head includes such as, e.g., a substrate, an LED array made of plural LED elements and attached to the substrate in extending in an axial direction of the photosensitive drum, and lens arranged between the LED array and the photosensitive drum in extending in an axial direction of the photosensitive drum. Where the LED head is driven and where the respective LED elements are selectively emitted, the respective rays according to light emission are focused by the lens to form the electrostatic latent images upon radiation to the surface of the photosensitive drum (see, e.g., Japanese Patent Application Publication No. 2011-88,384 (A1)).

With the prior art printer, however, the toner may attach to the LED head to make the lens surface dusty during the printing operation, so that electrostatic latent images may not be formed accurately where rays according to the LED elements' light emissions are not radiated properly onto the surface of the photosensitive drum, and so that the printer may resultantly suffer from inferior image quality.

It is an object of the invention to provide an image forming apparatus solving above problems on prior art printers, being capable of cleaning the exposure device of the image forming apparatus, and preventing the image quality of the image forming apparatus from becoming inferior.

SUMMARY OF THE INVENTION

To solve the above problems, an image forming apparatus according to the invention includes: an image forming unit having an image carrier and being arranged detachably to an apparatus body; a unit supporting member provided to the apparatus body, for supporting the image forming unit in a detachably inserting manner; and an exposure device, arranged in facing the image carrier while the image forming unit is attached to the apparatus body, for exposing a surface of the image carrier, wherein the unit supporting member includes a first contact supporting portion for supporting the image forming unit, and a second contact supporting portion disposed on a downstream side of the first contact supporting portion in a taking out direction of the image forming unit from the unit supporting member for forming a step portion projecting from a level of the first contact supporting portion, and wherein the image forming unit includes a first contact supported portion contacting and being supported by the first contact supporting portion, a second contact supported portion contacting and being supported by the second contact supporting portion, and a cleaner for cleaning the exposure device when the image forming unit is taken out from the unit supporting member.

According to the image forming apparatus of the invention, the exposure device can be cleaned as the image forming unit is taken out from the unit supporting member. Consequently, light from the exposure device is surely radiated to the surface of the image carrier to form latent images accurately, so that the image forming apparatus can prevent the image quality from becoming inferior.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 7A is a side view showing the restriction guide member according to the first embodiment of the invention, while

FIG. 12A is a first schematic side view showing the cleaner when the image forming unit is taken out from the restriction guide member according to the first embodiment of the invention, while

FIG. 13A is a second schematic side view showing the cleaner when the image forming unit is taken out from the restriction guide member according to the first embodiment of the invention, while

FIG. 15A is a third schematic side view showing the cleaner when the image forming unit is taken out from the restriction guide member according to the first embodiment of the invention, while

FIG. 16A is a first schematic side view showing the cleaner when the image forming unit is inserted into the restriction guide member according to the first embodiment of the invention, while

FIG. 17A is a second schematic side view showing the cleaner when the image forming unit is inserted into the restriction guide member according to the first embodiment of the invention, while

FIG. 18A is a third schematic side view showing the cleaner when the image forming unit is inserted into the restriction guide member according to the first embodiment of the invention, while

FIG. 23A is a first schematic side view showing the cleaner when the image forming unit is taken out from the restriction guide member according to the second embodiment of the invention, while

FIG. 24A is a second schematic side view showing the cleaner when the image forming unit is taken out from the restriction guide member according to the second embodiment of the invention while

FIG. 25A is a third schematic side view showing the cleaner when the image forming unit is taken out from the restriction guide member according to the second embodiment of the invention while

FIG. 26A is a first schematic side view showing the cleaner when the image forming unit is inserted into the restriction guide member according to the second embodiment of the invention while

FIG. 27A is a second schematic side view showing the cleaner when the image forming unit is inserted into the restriction guide member according to the second embodiment of the invention, while FIG. 28A is a third schematic side view showing the cleaner when the image forming unit is inserted into the restriction guide member according to the second embodiment of the invention, while

DETAILED DESCRIPTION OF EMBODIMENTS

First Embodiment

Referring to drawings, an embodiment of an information processing apparatus according to the invention is described. In this embodiment, a multicolor printer is described as the image forming apparatus.

Figure 2:
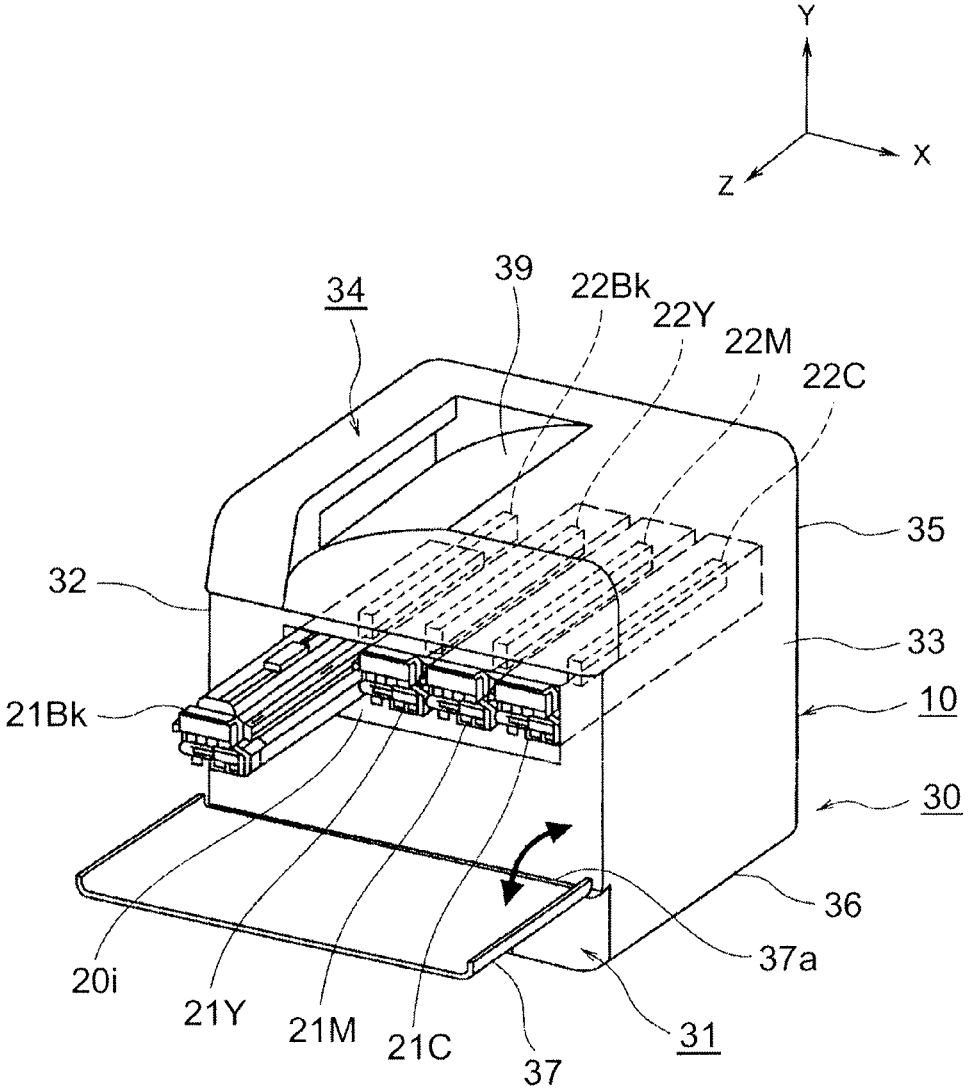
FIG. 2 is a perspective view showing a printer according to the first embodiment of the invention.
Figure 3:
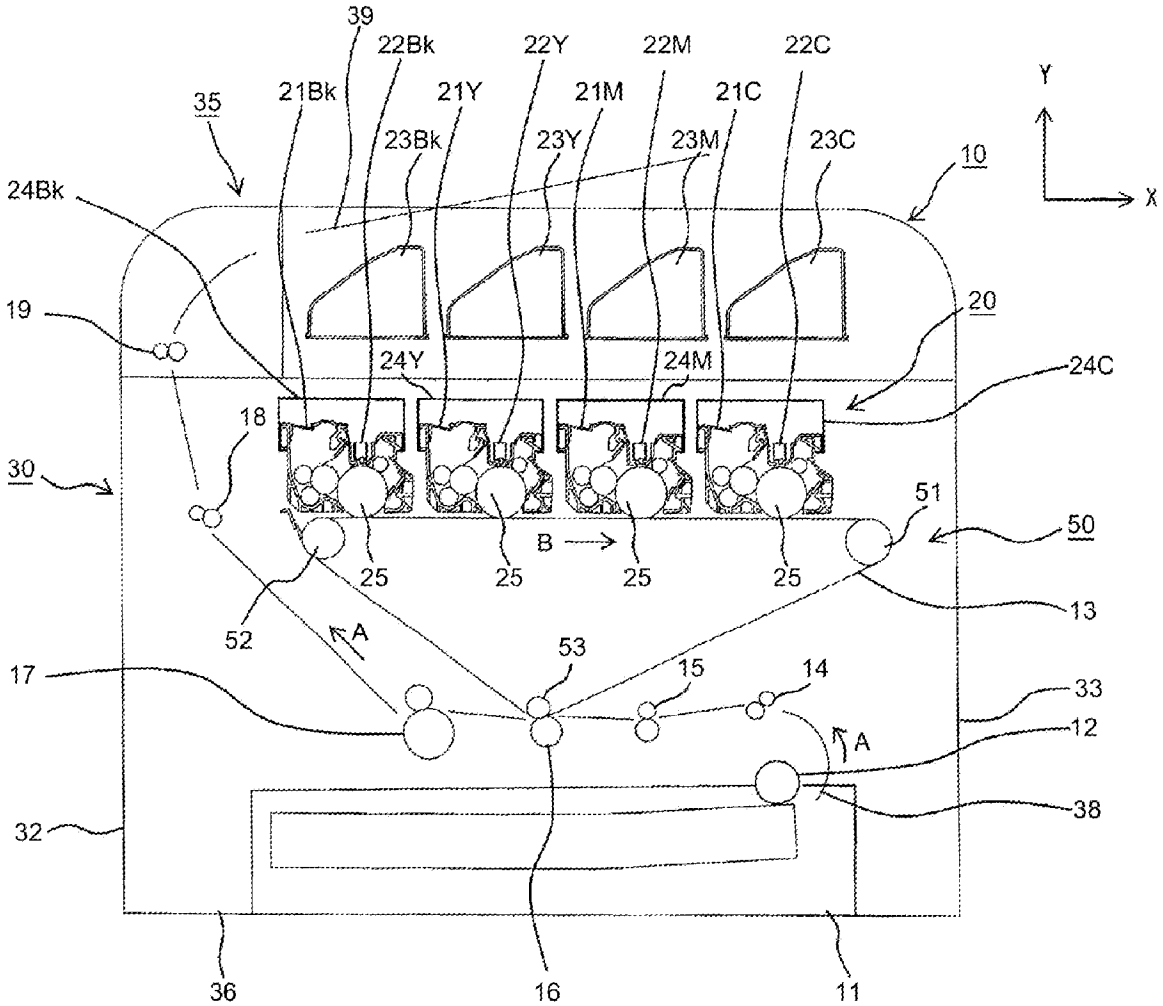
FIG. 3 is a schematic view showing a printer according to the first embodiment of the invention.

FIG. 2 is a perspective view showing a printer according to the first embodiment of the invention; FIG. 3 is a schematic view showing a printer according to the first embodiment of the invention.

In FIG. 2 and FIG. 3, a multicolor type printer 10 has an apparatus housing 30; the apparatus housing 30 includes a front wall 31, a left side wall 32 located on a left side when viewed from the front wall 31, a right side wall 33 located on a right side when viewed from the front wall 31, a top wall 34, a rear wall 35, and a bottom wall 36. An exterior cover 37 is arranged openably around a hinge 37*a* as a shaft for open and close movements in arrow directions at the front wall 31.

In this embodiment, a direction extending between the side wall 32 and the side wall 33, as a width direction of the printer 10, is defined as X-direction as a first direction; a direction extending between the bottom wall 36 and the top wall 34, as a height direction of the printer 10, is defined as Y-direction as a second direction; and a direction extending between the rear wall 35 and the front wall 31, as a depth direction of the printer 10, is defined as Z-direction as a third direction. The direction orienting from the side wall 32 to the side wall 33 in X-direction is defined as +X-direction (arrow direction in FIGS. 2, 3), and the direction orienting from the side wall 33 to the side wall 32 in X-direction is defined as −X-direction. The direction orienting from the bottom wall 36 to the top wall 34 in Y-direction is defined as +Y-direction (arrow direction in FIGS. 2, 3), and the direction orienting from the top wall 34 to the bottom wall 36 in Y-direction is defined as −Y-direction. The direction orienting from the rear wall 35 to the front wall 31 in Z-direction is defined as +Z-direction (arrow direction in FIGS. 2, 3), and the direction orienting from the front wall 31 to the rear wall 35 in Z-direction is defined as −Z-direction.

A paper cassette 11 is provided at a lower portion of a body of the printer 10, or namely an apparatus body, for containing paper as a medium, serving as a medium container. A hopping roller 12 is arranged at an end of the paper cassette 11 on a side of the side wall 33, or at a right end of the housing, serving as a feeding member for feeding sheet by sheet the paper to a medium conveyance path 38 upon being driven to rotate.

The medium conveyance path 38 has a shape of a letter S. The paper fed from the hopping roller 12 is conveyed along the medium conveyance path 38 in a direction of arrow A, and is ejected onto a stacker 39 formed on the top wall 34 and stacked on the stacker 39.

An image forming section 20 is arranged on an upper portion of the apparatus body for forming toner images as developer images in respective colors, namely, black, yellow, cyan, and magenta. A transfer section 50 is arranged near and below the image forming section 20 for transferring respective color toner images onto the paper.

The image forming section 20 includes: image forming units 21Bk, 21Y, 21M, 21C provided respectively extending from a side of the front wall 31 (+Z-direction) to a side of the rear wall 35 (−Z-direction) in a manner adjacent to each other from a side of the side wall 32 (−X-direction) to a side of the side wall 33 (+X-direction); LED heads 22Bk, 22Y, 22M, 22C as exposure devices provided extending from the side of the front wall 31 (+Z-direction) to the side of the rear wall 35 (−Z-direction) in facing each photosensitive drum 25 of the image forming units 21Bk, 21Y, 21M, 21C as an image carrier; restriction guide members 24Bk, 24Y, 24M, 24C as unit supporting members supporting the image forming units 21Bk, 21Y, 21M, 21C and the LED heads 22Bk, 22Y, 22M, 22C; and toner cartridges 23Bk, 23Y, 23M, 23C as developer containers arranged above the restriction guide members 24Bk, 24Y, 24M, 24C respectively extending from a side of the front wall 31 (+Z-direction) to a side of the rear wall 35 (−Z-direction) in a manner adjacent to each other from a side of the side wall 32 (−X-direction) to a side of the side wall 33 (+X-direction). The image forming units 21Bk, 21Y, 21M, 21C and the toner cartridges 23Bk, 23Y, 23M, 23C are detachably provided to the apparatus body, respectively. An insertion portion 20*i* for a hollow having a rectangular cross section is formed at the apparatus body to detachably insert image forming units 21Bk, 21Y, 21M, 21C.

The transfer section 50 includes: a drive roller 51 arranged below the image forming unit 21C in a rotatable manner as a first roller; a driven roller 52 arranged below the image forming unit 21Bk in a rotatable manner as a second roller; a tension roller 53 arranged in a rotatable manner as a third roller facing the medium conveyance path 38; a transfer belt 13 as a primary transfer body being tensioned with the drive roller 51, the driven roller 52, and the tension roller 53, being driven in arrow B according to the rotation of the drive roller 51, and being transferred of the toner images in respective colors according to the drive in an overlapping manner to form multicolor toner images; and a transfer roller 16, as a secondary transfer body, arranged facing the tension roller 53 via the transfer belt 13 at the medium conveyance path 38 to transfer the multicolor toner images onto the paper.

The medium conveyance path 38 is formed with, on a downstream side of the hopping roller 12, a register roller pair 14 for collecting skewed feeding of the paper fed with the hopping roller 12, and with, on a downstream side of the register roller pair 14 and on an upstream side of the transfer roller 16, a conveyance roller pair 15 for feeding the paper to a transfer region formed at a portion that the transfer belt 13 contacts the transfer roller 16.

The medium conveyance path 38 is further formed with, on a downstream side of the transfer roller 16, a fixing device 17 fixing multicolor toner images transferred on the paper, to the paper to form multicolor images, with, on a downstream side of the fixing device 17, a conveyance roller pair 18 arranged for conveying the paper formed with the multicolor images, and with, on a downstream side of the conveyance roller pair 18, a delivery roller pair 19 arranged for ejecting the paper out of the apparatus body.

Next, the image forming units 21Bk, 21Y, 21M, 21C and the LED heads 22Bk, 22Y, 22M, 22C are described. In this embodiment, the image forming units 21Bk, 21Y, 21M, 21C have substantially the same structure, and the LED heads 22Bk, 22Y, 22M, 22C also have substantially the same structure, so that only the image forming unit 21Bk and the LED head 22Bk are described for the sake of brevity.

Figure 4:
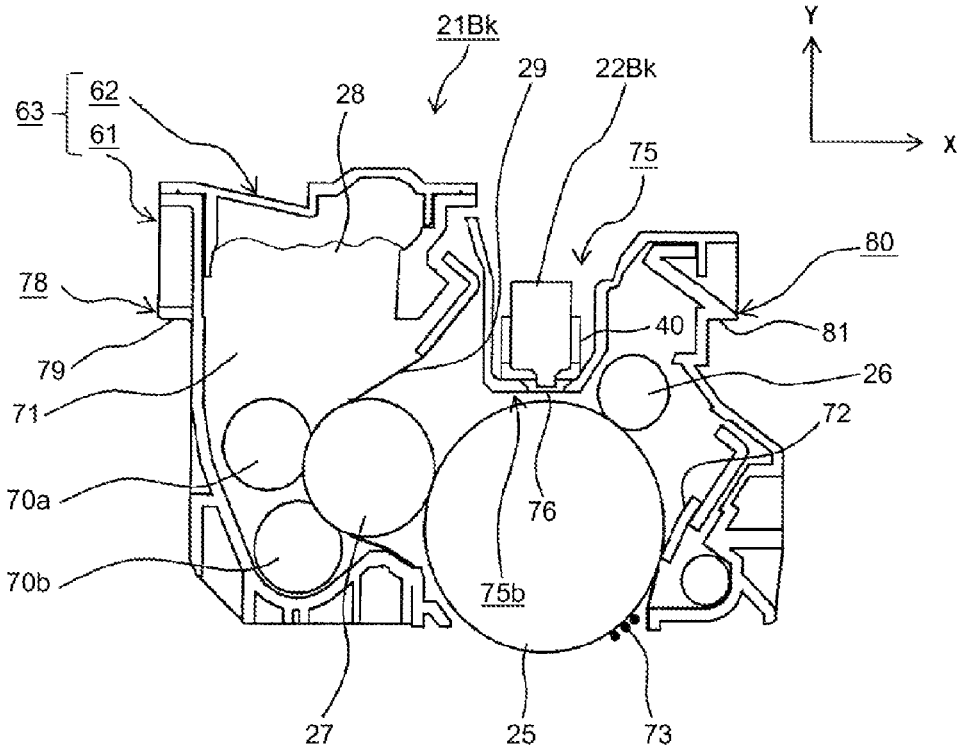
FIG. 4 is a schematic view showing an image forming unit and the LED head according to the first embodiment of the invention.
Figure 5:
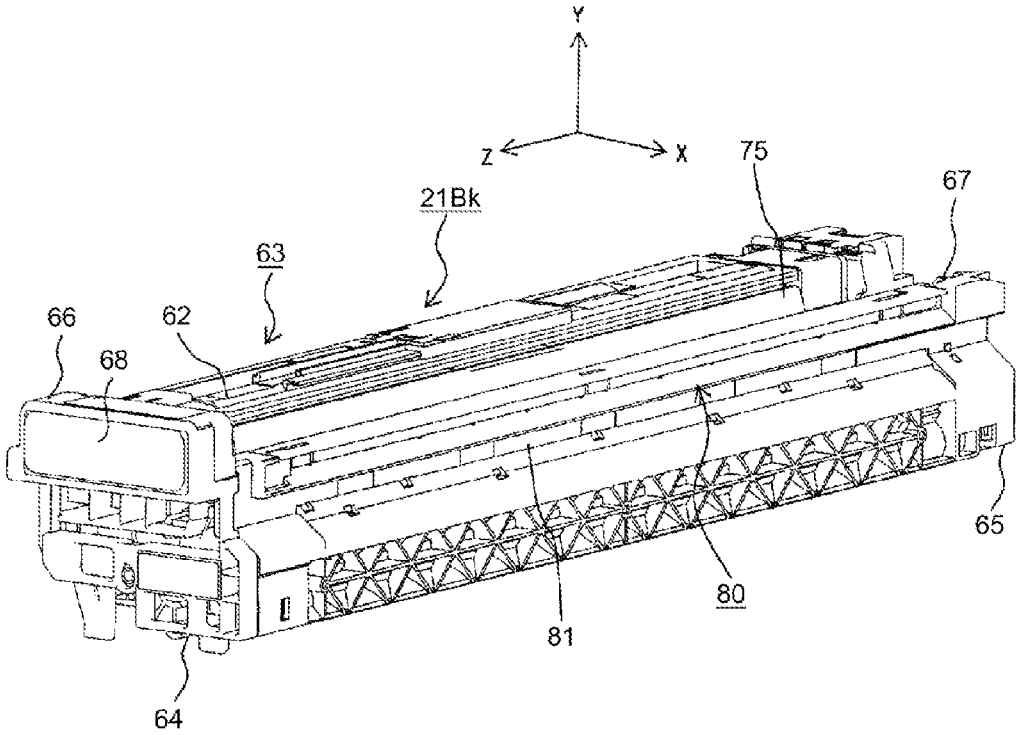
FIG. 5 is a first perspective view showing the image forming unit according to the first embodiment of the invention.
Figure 6:
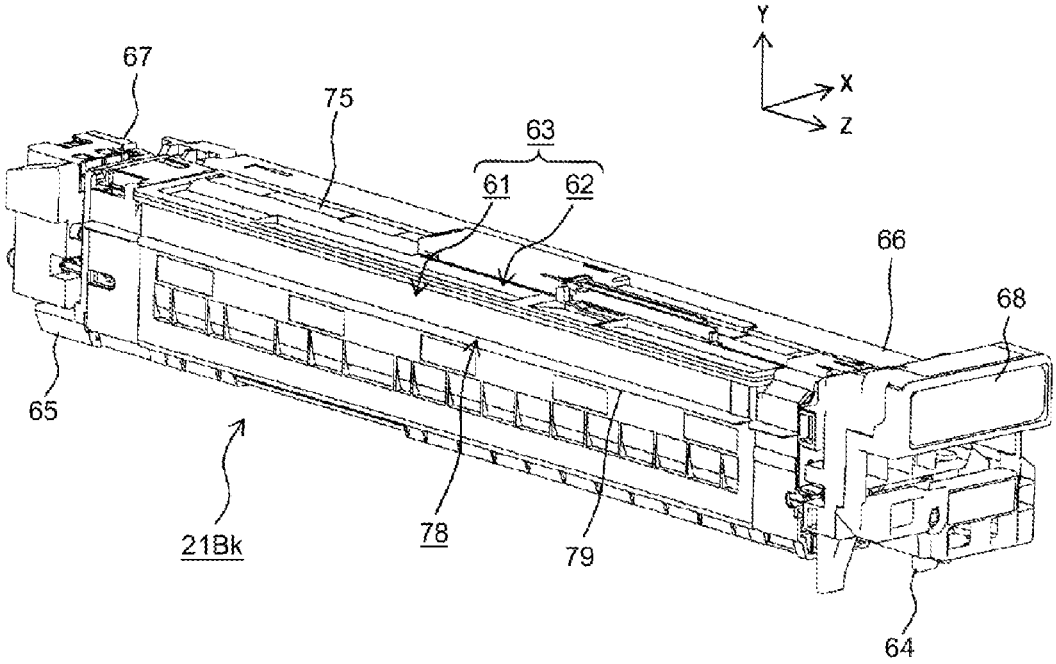
FIG. 6 is a second perspective view showing the image forming unit according to the first embodiment of the invention.

FIG. 4 is a schematic view showing the image forming unit and the LED head according to the first embodiment of the invention; FIG. 5 is a first perspective view showing the image forming unit according to the first embodiment of the invention; FIG. 6 is a second perspective view showing the image forming unit according to the first embodiment of the invention.

In FIGS. 4 to 6, the image forming unit 21Bk includes: a housing 63 made of a lower frame 61 as a first housing portion opening at a top end and of an upper cover 62 as a second housing portion covering the lower frame from an upper side thereof; a rear cover 64 for shielding the housing 63 at a rear end 66 of the image forming unit 21Bk or namely at an end on a side in +Z-direction; and a front cover 65 for shielding the housing 63 at a front end 67 of the image forming unit 21Bk or namely at an end on a side in −Z-direction. A grip portion 68 is formed at the rear cover 64.

In the housing 63 of the image forming unit 21Bk, included are: the photosensitive drum 25 arranged rotatably for forming electrostatic latent images as latent image on a surface thereof; a charge roller 26, as a charging device, arranged rotatably for charging uniformly the surface of the photosensitive drum 25; a developing roller 27 as a developer carrier arranged rotatably in pressurized contact with the photosensitive drum 25 for forming toner images by attaching toner 28 as developer to the electrostatic latent images to make developments; a developing blade 29 as a developer limiting member arranged in pressurized contact with the developing roller 27 for making the toner 28 on the surface of the developing roller 27 into a thin layer; a pair of toner supply rollers 70*a*, 70*b* as developer supply members arranged in pressurized contact with the developing roller 27 for supplying toner 28 to the developing roller 27; and a cleaning member 72 removing the remaining toner 73 as a remaining developer by wiping out the toner remaining on the surface of the photosensitive drum 25 after the toner images are transferred to the transfer belt 13 (see, FIG. 3).

A toner container 71 serving as a developer containing chamber is formed above the developing roller 27, the developing blade 29, and the toner supply rollers 70*a*, 70*b* in the housing 63, and the toner container 71 contains the toner 28 supplied from the toner cartridge 23Bk.

The upper cover 62 is formed with a groove portion 75 for containing the LED head 22Bk when the image forming unit 21Bk is attached to the apparatus body. The groove portion 75 is formed extending from the rear end 66 (the end on a side in +Z-direction) to the front end 67 (the end on a side in −Z-direction) of the image forming unit 21Bk and formed with an opening 76 passing light from plural LED elements not shown but arranged at the LED head 22Bk, at a portion facing to the LED head 22Bk positioned at a bottom 75*b* of the groove portion 75.

A cleaner 40 is formed at a prescribed location in a longitudinal direction (Z-direction) of the groove portion 75, or in this embodiment, at the front end 67 of the image forming unit 21Bk so as to project in a prescribed amount from the bottom 75*b* of the groove portion 75 to wipe the LED head 22Bk.

A projecting portion 78 as a first engaged portion is formed projecting horizontally outwardly on a side surface of the lower frame 61 on a side of the side wall 32 as extending from the rear end 66 to the front end 67 of the image forming unit 21Bk in the longitudinal direction (Z-direction), and a receiving surface 79 as a supported portion is formed on a lower surface of the projecting portion 78 along the entire length in the longitudinal direction.

Another projecting portion 80 as a second engaged portion is formed projecting horizontally outwardly on the other side surface of the lower frame 61, or namely on a side surface on a side of the side wall 33 (+X-direction) as extending from the rear end 66 to the front end 67 of the image forming unit 21Bk in the longitudinal direction (Z-direction), and a receiving surface 81 as a supported portion is formed on a lower surface of the projecting portion 80 along the entire length in the longitudinal direction. It is to be noted that the receiving surfaces 79, 81 are formed at the same level in the height direction (+Y-direction) of the image forming unit 21Bk at the projecting portions 78, 80, respectively. The projecting portions 78, 80 are separated between the rear cover 64 and the housing 63 as well as between the housing 63 and the front cover 65, but the receiving surfaces 79, 81 are formed continuously.

In operation of the printer 10 thus formed, when a conveyance motor not shown as a drive unit for conveying media is driven to rotate the hopping roller 12 (see, FIG. 3), the paper contained in the paper cassette 11 is separated sheet by sheet and fed to the medium conveyance path 38. The fed paper is conveyed with the register roller pair 14 and the conveyance roller pair 15, thereby fed to the transfer region between the transfer belt 13 and the transfer roller 16.

In each of the image forming units 21Bk, 21Y, 21M, 21C, a drum motor, not shown, serving as a drive unit for image formation, is driven to rotate the photosensitive drum 25, and with this rotation, the charge roller 26 is rotated to uniformly charge the surface of the photosensitive drum 25, which is exposed with the LED heads 22Bk, 22Y, 22M, 22C to form electrostatic latent images.

To do this operation, each of the LED heads includes such as, e.g., a substrate not shown, an LED array made of plural LED elements mounted on the substrate and arranged in extending in an axial direction (Z-direction) of the photosensitive drum 25, and a lens not shown serving as an optical system arranged extending in an axial direction of the photosensitive drum 25. When a controller, not shown, sends image data to the LED heads 22Bk, 22Y, 22M, 22C, the respective LED heads 22Bk, 22Y, 22M, 22C are driven to selectively emit light, and the surface of the photosensitive drum 25 is radiated by focusing the respective lights generated according to the emissions with the lens, thereby forming the electrostatic latent images.

According to the rotation of the photosensitive drum 25, the developing roller 27 is rotated, and the toner supply rollers 70*a*, 70*b* are rotated. The toner 28 supplied to the toner container 71 from the toner cartridges 23Bk, 23Y, 23M, 23C is further supplied to the developing roller 27 according to rotations of the toner supply rollers 70*a*, 70*b*, and is made into a thin layer by the developing blade 29 on the developing roller 27. The thin layered toner 28 is attached to the electrostatic latent images of the photosensitive drum 25 by electrostatic force to develop the electrostatic latent images, thereby forming the toner images in black, yellow, magenta, cyan on the respective photosensitive drums 25.

In the transfer section 50, when a belt motor, not shown, serving as a drive unit for belt drive, is driven to render the transfer belt 13 along the respective image forming units 21Bk, 21Y, 21M, 21C, the toner images in the respective colors on the respective photosensitive drums 25 are sequentially transferred onto the transfer belt 13 in an overlapping manner, thereby forming multicolor toner images and transferring the multicolor toner images onto the paper at the transfer section.

Subsequently, the paper is sent to the fixing device 17, and the multicolor toner images are heated at the fixing device 17 and thereby pressed to and fixed onto the paper. The printed paper thus formed with the multicolor images is fed by the conveyance roller pair 18, and ejected outside the apparatus body by the delivery roller pair 19 and stacked on the stacker 39.

As described above, the image forming units 21Bk, 21Y, 21M, 21C are arranged in a manner detachable from the apparatus body.

The insertion portion 20*i* is therefore formed below the toner cartridges 23Bk, 23Y, 23M, 23C in the apparatus body. Where the exterior cover 37 is opened, the image forming units 21Bk, 21Y, 21M, 21C can be taken out from the insertion portion 20*i* by moving the image forming units 21Bk, 21Y, 21M, 21C toward a near side in FIG. 2 (or namely, +Z-direction, an extracting direction), and can be inserted into the insertion portion 20*i* by moving the image forming units 21Bk, 21Y, 21M, 21C toward a far side in FIG. 2 (or namely, −Z-direction, an inserting direction), so that the image forming units 21Bk, 21Y, 21M, 21C can be inserted and taken out individually.

In such a situation, the restriction guide members 24Bk, 24Y, 24M, 24C are arranged in the insertion portion 20*i* to allow each of the image forming units 21Bk, 21Y, 21M, 21C to be smoothly inserted into and taken out of the insertion portion 20*i*, and the restriction guide members 24Bk, 24Y, 24M, 24C support the image forming units 21Bk, 21Y, 21M, 21C in a way that the unit can readily be inserted and taking out. The restriction guide members 24Bk, 24Y, 24M, 24C restrict insertion and taking out tracks by restricting the image forming units 21Bk, 21Y, 21M, 21C from moving in a width direction (X-direction) approximately perpendicular to the insertion direction of the image forming units 21Bk, 21Y, 21M, 21C. Accordingly, the image forming units 21Bk, 21Y, 21M, 21C can be inserted into and taken out from the insertion portion 20*i* in the insertion or taking out direction (−Z-direction or +Z-direction) by inserting and taking out the image forming units 21Bk, 21Y, 21M, 21C into and from the restriction guide members 24Bk, 24Y, 24M, 24C, respectively.

Next, the restriction guide members 24Bk, 24Y, 24M, 24C are described. In this embodiment, only the restriction guide member 24Bk is described because the restriction guide members 24Bk, 24Y, 24M, 24C have substantially the same structure.

Figure 1:
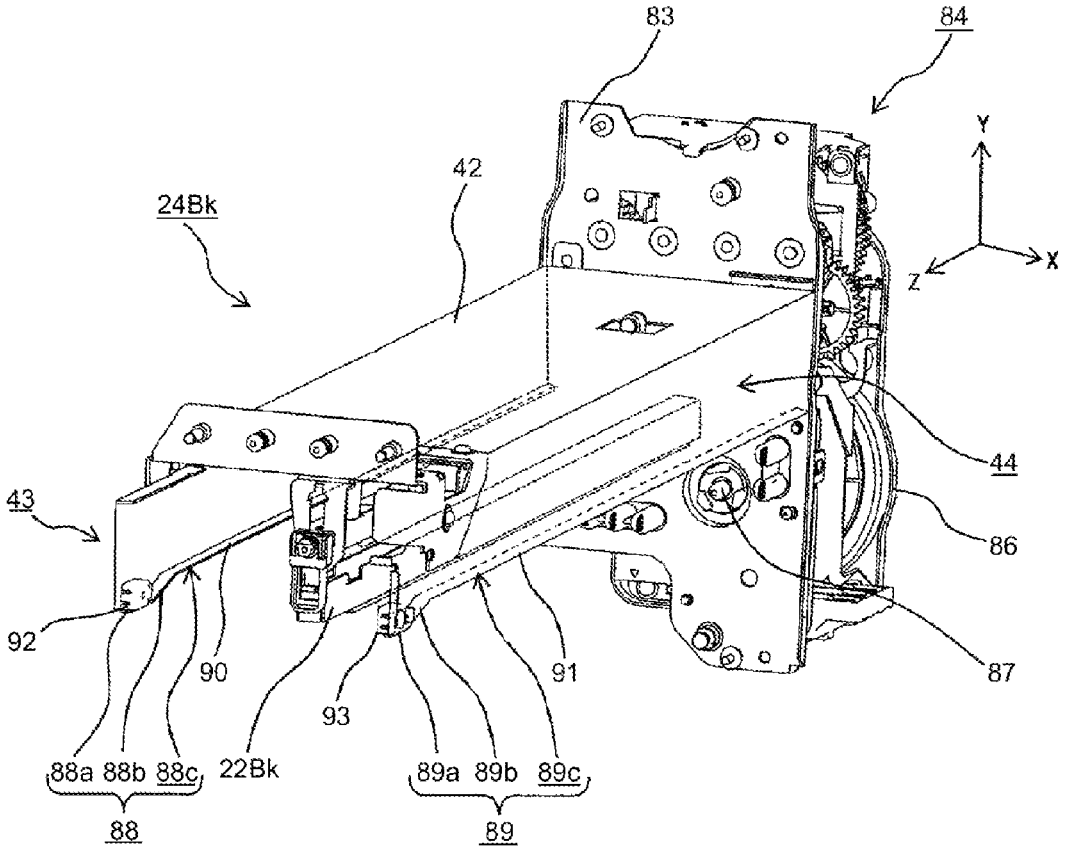
FIG. 1 is a perspective view showing a restriction guide member and an LED head in an installation state according to a first embodiment of the invention.
Figure 7B:
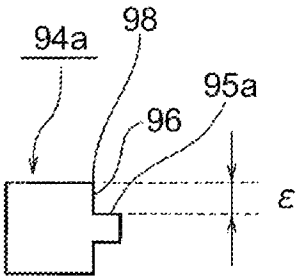
FIG. 7B is an enlarged side view showing a stopper member shown in FIG. 7A.
Figure 7A:
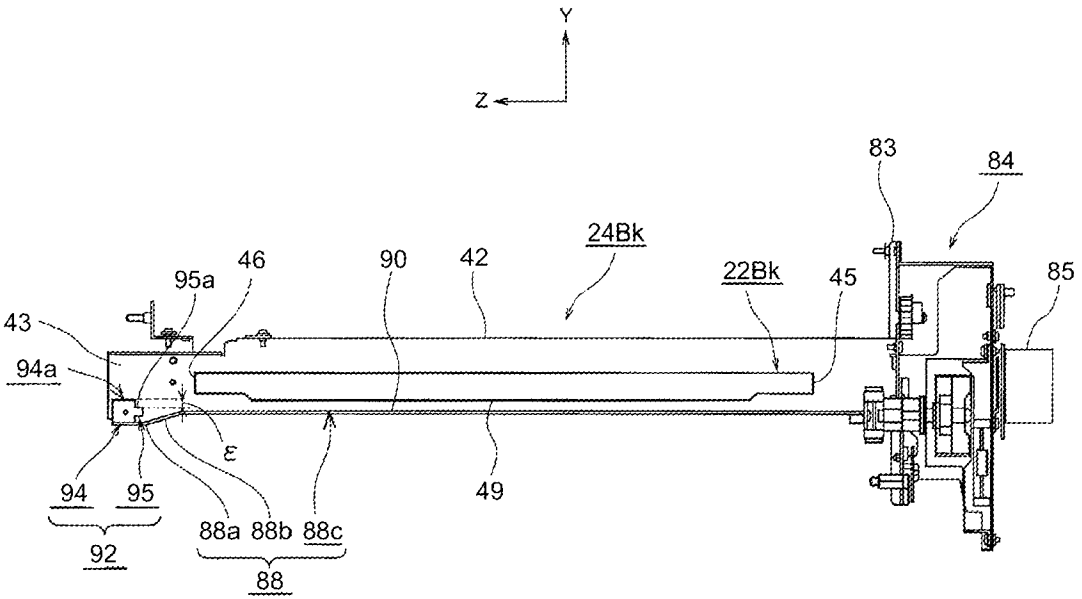
Figure 8:
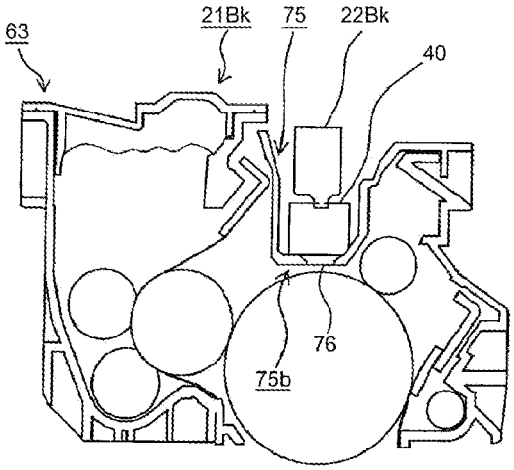
FIG. 8 is a schematic view showing the image forming unit and the LED head in a state that the LED head is placed at a non-exposure position according to the first embodiment of the invention.
Figure 9:
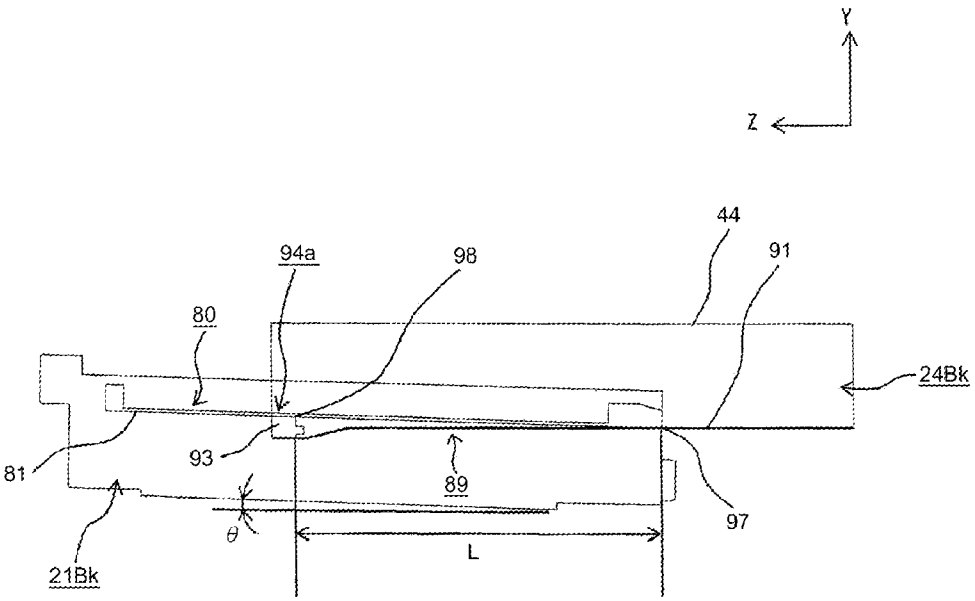
FIG. 9 is a schematic view showing a relationship between the image forming unit and the restriction guide member at a time that the image forming unit is inserted into the restriction guide member according to the first embodiment of the invention.

FIG. 1 is a perspective view showing a restriction guide member and an LED head in an installation state according to a first embodiment of the invention; FIG. 7 is a side view showing the restriction guide member according to the first embodiment of the invention; FIG. 8 is a schematic view showing the image forming unit and the LED head in a state that the LED head is placed at a non-exposure position according to the first embodiment of the invention; FIG. 9 is a schematic view showing a relationship between the image forming unit and the restriction guide member at a time that the image forming unit is inserted into the restriction guide member according to the first embodiment of the invention.

In FIG. 1, the restriction guide member 24Bk is formed extending in the longitudinal direction (Z-direction) of the image forming unit 21Bk from a side of the front wall 31 to a side of the rear wall 35 of the printer 10, and is formed as a restriction guide. The restriction guide member 24Bk is secured to the apparatus body by attaching a front end of the restriction guide member 24Bk to an upright chassis 83 disposed on a side of the rear wall 35 of the printer 10 in the insertion portion 20*i*.

The restriction guide member 24Bk is made to move in the height direction (Y-direction) of the printer 10 according to operation of a lifting mechanism not shown but made of a link mechanism in association with opening and closing operation of the exterior cover 37. Where the exterior cover 37 is closed, the restriction guide member 24Bk is set to an image forming unit operating position as a first position. Where the exterior cover 37 is open, the restriction guide member 24Bk is set to an image forming unit escaping position as a second position. At the image forming unit operating position, the image forming unit 21Bk supported by the restriction guide member 24Bk is set to a transfer position, and the photosensitive drum 25 is made in contact with the transfer belt 13. At an image forming unit escaping position, the image forming unit 21Bk is set to a non-transfer position, and the photosensitive drum 25 is moved adequately away from the transfer belt 13.

A drive unit 84 is provided to operate the image forming unit 21Bk at a rear side of the upright chassis 83 (−Z-direction). The drive unit 84 includes such as, e.g., a drum motor 85, and a gear 86 for transmitting rotation of the drum motor 85 to the photosensitive drum 25. Where the image forming unit 2lBk is inserted into the insertion portion 20*i* and attached to the apparatus body, a transmission shaft 87 of the gear 86 is coupled with the shaft of the photosensitive drum 25 in a state urged with prescribed urging force.

The restriction guide member 24Bk is formed by folding a metal plate material. The restriction guide member 24Bk includes such as, e.g., a top plate 42 in a rectangular plate shape, a pair of side plates 43, 44 formed in a shape pending downward from each side edge of the top plate 42 and extending in a longitudinal direction (Z-direction), and a pair of supporting edges 88, 89 projecting inward (or namely coming close to each other) and extending in a strip shape in the longitudinal direction (or namely the insertion direction of the image forming unit 21Bk with respect to the insertion portion 20*i*) serving as first and second engagement portions.

The LED head 22Bk is attached as pending from a back surface of the top plate 42 at a prescribed position in the width direction of the restriction guide member 24Bk. The LED head 22Bk is moved in the height direction of the printer 10 (Y-direction) with respect to the restriction guide member 24Bk in association with the movement of the lifting mechanism and is set to the exposure position as shown in FIG. 4 as the first position and to the non-exposure position as shown in FIG. 8 as the second position. The LED head 22Bk is positioned closely to the image forming unit 21Bk to expose the surface of the photosensitive drum 25, when placed to the exposure position, and is positioned away from the image forming unit 21Bk to allow the image forming unit 21Bk to be inserted into and taken out from the restriction guide member 24Bk, when placed to the non-exposure position.

The supporting edge 88 includes a lower supporting portion 88*a* formed at a rear end (the end on a side of +Z-direction) of the restriction guide member 24Bk as a downstream side end in the taken out direction (+Z-direction) of the image forming unit 21Bk, a slope supporting portion 88*b* formed as inclined diagonally upward adjacent to the lower supporting portion 88*a*, and an upper supporting portion 88*c* formed adjacent to the slope supporting portion 88*b* in extending horizontally up to the front end (the end on a side of −Z-direction) of the restriction guide member 24Bk as an upstream side end in the taken out direction (+Z-direction) of the image forming unit 21Bk, and a supporting surface 90 is formed as a top surface of the upper supporting portion 88*c*. The supporting edge 89 includes a lower supporting portion 89*a* formed at a rear end (the end on a side of +Z-direction) of the restriction guide member 24Bk as a downstream side end in the taken out direction (+Z-direction) of the image forming unit 21Bk, a slope supporting portion 89*b* formed as inclined diagonally upward adjacent to the lower supporting portion 89*a*, and an upper supporting portion 89*c* formed adjacent to the slope supporting portion 89*b* in extending horizontally up to the front end (the end on a side of −Z-direction) of the restriction guide member 24Bk as an upstream side end in the taken out direction (+Z-direction) of the image forming unit 21Bk, and a supporting surface 91 is formed as a top surface of the upper supporting portion 89*c*. The supporting edges 88, 89 are formed at substantially the same level in the height direction (+Y-direction) of the restriction guide member 24Bk and so formed that the supporting surfaces 90, 91 are positioned at a prescribed distance below the lower end of the LED head 22Bk.

The distance between the side plates 43, 44 of the restriction guide member 24Bk is set to a distance slightly larger than a width of the image forming unit 21Bk, or namely, a distance between the ends of the projecting portions 78, 80.

Accordingly, by engagement between the projecting portions 78, 80 of the image forming unit 21Bk and the supporting edges 88, 89 of the restriction guide member 24Bk in this embodiment, the projecting portions 78, 80 are positioned above the supporting edges 88, 89 to render the supporting surfaces 90, 91 and the receiving surfaces 79, 81 face each other, thereby positioning the image forming unit 21Bk with respect to the restriction guide member 24Bk and allowing the image forming unit 21Bk to be inserted into and taken out from the restriction guide member 24Bk.

The restriction guide member 24Bk restricts the image forming unit 21Bk from moving in the width direction (X-direction), because the tips of the projecting portions 78, 80 slide on inner side surfaces of the side plates 43, 44 of the restriction guide member 24Bk during a period that image forming unit 21Bk is inserted into or taken out from the restriction guide member 24Bk.

Resin made stopper members 92, 93 serving as securing members are attached to the lower supporting portions 88*a*, 89*a* located at inner side surfaces of the side plates 43, 44 (or namely, downstream side ends in the taken out direction of the image forming unit 21Bk) by screws, not shown, respectively. The stopper members 92, 93 prevent the image forming unit 21Bk from detaching from the restriction guide member 24Bk. The stopper members 92, 93 have a thickness, which is equal to the width of the supporting surfaces 90, 91 in the width direction (X-direction) of the restriction guide member 24Bk, so that the stopper members 92, 93 do not project inward from the edges of the lower supporting portions 88*a*, 89*a*.

Each of the stopper members 92, 93 is formed with a body portion 94 formed in a rectangular shape, and a projection 95 formed in projecting forward (−Z-direction) from the body portion 94, and the a top surface 94*a* of the body portion 94 is formed at a higher position than that of a top surface 95*a* of the projection 95.

The top surface 95*a* of the projection 95 and the supporting surfaces 90, 91 of the supporting edges 88, 89 are placed at the same plane in the height direction (Y-direction) of the restriction guide member 24Bk, and a step portion 96 is formed with a level difference ϵ in the height direction (Y-direction) of the restriction guide member 24Bk between a front end 98 (an end on a side in −Z-direction) of the top surface 94*a* of the body portion 94 and the top surface 95*a* of the projection 95 as well as the supporting surfaces 90, 91. The step portion 96 is projecting from a level of the supporting surfaces 90, 91 by the level difference ϵ where the restriction guide member 24Bk is provided as extending horizontally.

The top surface 95*a* of the projection 95 as well as the supporting surfaces 90, 91 constitute a first supporting portion, whereas the top surface 94*a* of the body portion 94 constitutes a second supporting portion.

As described above, the LED head 22Bk is disposed as contained inside the groove portion 75 when the image forming unit 21Bk is inserted into the restriction guide member 24Bk. The LED head 22Bk is shorter in the longitudinal direction than the restriction guide member 24Bk; a front end 45 (an end on a side of −Z-direction) is placed behind the front end of the restriction guide member 24K, whereas a rear end 46 (an end on a side of +Z-direction) is placed ahead of the rear end of the restriction guide member 24Bk.

The lens is disposed at the lower end of the LED head 22Bk, and the cleaner 40 disposed at the groove portion 75 is made to slide over a lens surface 49 of the lens when the image forming unit 21Bk is taken out from the restriction guide member 24Bk.

Operation of the image forming unit 21Bk when the image forming unit 21Bk is inserted into the restriction guide member 24Bk is described next.

When the image forming unit 21Bk is inserted into the restriction guide member 24Bk, the receiving surfaces 79, 81 of the projecting portions 78, 80 of the image forming unit 21Bk are made in contact with the front end 98 (the end on the side in −Z-direction) of the top surface 94*a* of the stopper members 92, 93.

Where the image forming unit 21Bk is moved forward (moved in −Z-direction), a front end 97 (the end on the side in −Z-direction) of the receiving surfaces 79, 81 is made in contact with a prescribed portion of the supporting surfaces 90, 91, and the prescribed portion of the supporting surfaces 90, 91 is made in contact with the front end 98 of the top surface 94*a*. In this embodiment, the front end 97 of the receiving surfaces 79, 81 defines a first contact supported portion; a portion of the supporting surfaces 90, 91 contacting to the front end 97 of the receiving surfaces 79, 81 defines a first contact supporting portion; a portion of the receiving surfaces 79, 81 contacting to the front end 98 of the top surface 94*a* defines a second contact supported portion; the front end 98 of the top surface 94*a* of the stopper members 92, 93 defines a second contact supporting portion.

Subsequently, when the rear end of the receiving surfaces 79, 81 goes by the top surface 94*a* of the stopper members 92, 93, the rear end of the receiving surfaces 79, 81 as an end on an upstream side in the inserting direction of the image forming unit 24Bk is moved downward (−Y-direction) by the level difference ϵ of the step portion 96, so that the entire receiving surfaces 79, 81 come in contact with the supporting surfaces 90, 91 and that the insertion of the image forming unit 24Bk into the restriction guide member 21Bk finishes.

At that time, because urging force exerting between the transmission shaft 87 of the gears 86 and the shaft of the photosensitive drum 25 is further exerted toward +Z-direction to the image forming unit 24Bk, and because the urging force renders the rear end surface (end surface on a side of +Z-direction) of the projecting portions 78, 80 contact the end surface of the step portion 96, the restriction guide member 24Bk restricts the image forming unit 21 Bk from moving in the longitudinal direction (Z-direction).

To the contrary, when the image forming unit 21Bk is taken out from the restriction guide member 24Bk, the image forming unit 21Bk is moved backward (in +Z-direction as the taken-out direction) in a state that rendering the receiving surfaces 79, 81 contacting the supporting surfaces 90, 91 of the restriction guide member 24Bk as well as the top surface 94*a* of the stopper members 92, 93.

Where an insertion amount L is defined by a distance between the front end 97 of the receiving surfaces79, 81 and the front end 98 of the top surface 94a of the supper members 92, 93 during insertion and taking out operations of the image forming unit 24Bk with respect to the restriction guide member 24Bk, the image forming unit 21Bk is moved forward and backward while inclined to the restriction guide member 24Bk when inserted into and taken out from the restriction guide member 24Bk, because the top surface 94*a* of the stopper members 92, 93 is positioned higher by the level difference ϵ of the step portion 96 than the supporting surfaces 90, 91. An inclination θ to the horizontal surface is expressed as:

$$\theta=\tan^{-1}(\epsilon/L)$$

The inclination θ is different according to the insertion amount L; the inclination is larger as the insertion amount L is smaller, whereas the inclination is smaller as the insertion amount L is larger. When the image forming unit 21Bk is inserted into the restriction guide member 24Bk, the inclination θ is made gradually smaller during a period from the beginning of the insertion to the end of the insertion. To the contrary, when the image forming unit 21Bk is taken out from the restriction guide member 24Bk, the inclination θ is made gradually larger during a period from the beginning of taking-out to the end of taking-out.

Figure 10:
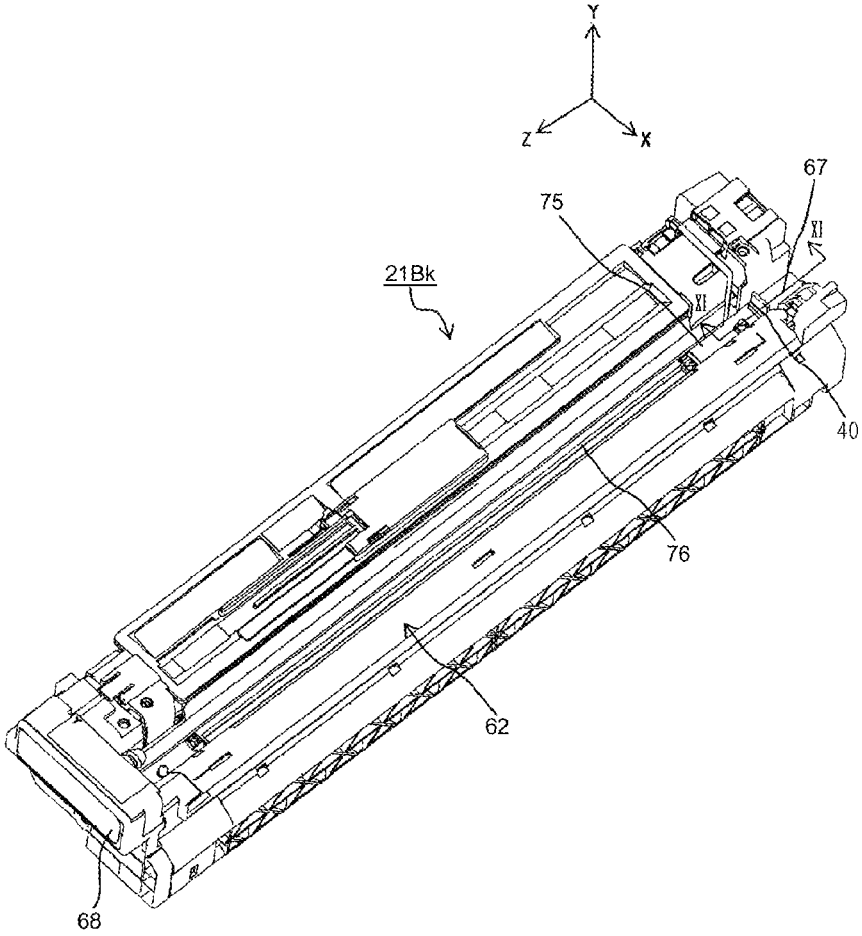
FIG. 10 is a perspective view showing the image forming unit and the restriction guide member with a cleaner in an installation state according to the first embodiment of the invention.
Figure 11:
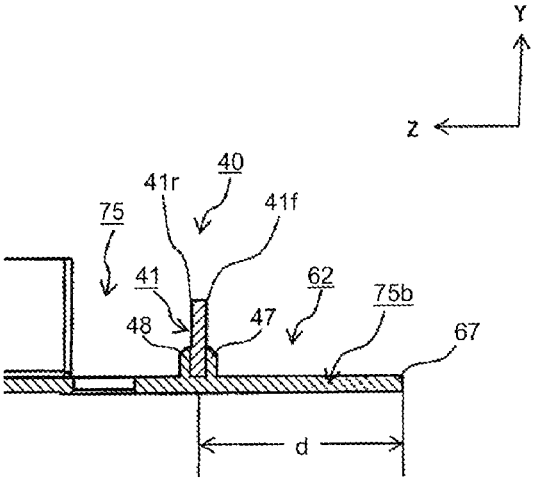
FIG. 11 is a cross section of the cleaner and vicinity thereof taken along XI-XI line in FIG. 10.

Next, the cleaner 40 is described. FIG. 10 is a perspective view showing the image forming unit and the restriction guide member with the cleaner in an installation state according to the first embodiment of the invention; FIG. 11 is a cross section of the cleaner and vicinity thereof taken along XI-XI line in FIG. 10.

As shown in FIGS. 10, 11, the cleaner 40 is disposed at a position at rear (on a downstream side in the taking out direction) of the front end 67 (front end 97, as well) of the image forming unit 21Bk by a distance d. In this embodiment, the distance d is set such that the cleaner 40 is positioned forwarder (on a downstream side in the taken out direction) than the front end 45 of the LED head 22Bk (see, FIG. 1) in a state that the image forming unit 21Bk is attached to the apparatus body. As the distance d becomes longer, a position changing amount of the cleaner 40 becomes larger in the height direction of the image forming unit 21Bk with respect to the inclination θ of the image forming unit 21Bk.

The cleaner 40 includes a plate shaped elastic body 41 formed in a rectangular shape and disposed as to project toward the lens surface 49 of the LED head 22Bk from a bottom 75*b* of the groove portion 75, and a pair of holders 47, 48 formed adjacent to front and rear end sides of the elastic body 41 in the longitudinal direction of the image forming unit 21Bk in a manner projecting from the bottom 75*b* of the groove portion 75 in a united body with the bottom 75*b* for holding a lower portion of the elastic body 41. The elastic body 41 extends in a direction substantially perpendicular to the taking out direction of the image forming unit 21Bk. The elastic body 41 is made of a sponge material having a thickness of 1 mm or more and of 3 mm or less, and in this embodiment, having a thickness of 2 mm. A first edge 41*f* is formed at a top edge at a front surface (on an upstream side in the taken out direction) of the elastic body 41 in the longitudinal direction of the image forming unit 21Bk, and a second edge 41*r* is formed at a top edge at a rear surface (on a downstream side in the taken out direction) of the elastic body 41. When the image forming unit 21Bk is taken out from the restriction guide member 24Bk, the elastic body 41 is made in contact with the lens surface 49 to bend the elastic body 41 forward in the longitudinal direction of the image forming unit 21Bk, and the second edge 41*r* is made in contact with the lens surface 49 to rub the lens surface 49.

Accordingly, if the toner 28 (see, FIG. 4) is attached to the lens surface 49 during the printing operation to cause occurrences of smears or the like on the images on the paper, the toner 28 attached to the lens surface 49 can be readily wiped out only by taking out the image forming unit 21Bk from the restriction guide member 24Bk, thereby cleaning the LED head 22Bk.

When the image forming unit 21Bk is inserted into the restriction guide member 24Bk, the elastic body 41 comes in contact with the lens surface 49 and is bent backward (on an upstream side in the inserting direction) in the longitudinal direction of the image forming unit 21Bk. The first edge 41*f*, which is not the second edge 41*r* contacting the lens surface 49 when the image forming unit 21Bk is taken out from the restriction guide member 24Bk, is made in contact with the lens surface 49, thereby rubbing the lens surface 49. In this situation, the toner 28 attached to the lens surface 49 is already wiped out when the image forming unit 21Bk is taken out from the restriction guide member 24Bk, thereby preventing the first edge 41*f* from becoming dusty. Moreover, the first edge 41*f* does not make the lens surface 49 dusty.

A tip height of the elastic body 41 from the bottom 75*b* is designed such that the elastic body 41 is bent as contacting the lens surface 49 while the image forming unit 21Bk is inserted into and taken out from the restriction guide member 24Bk. Thus, where the insertion of the image forming unit 21Bk into the restriction guide member 24Bk ends and where the image forming unit 21Bk is attached to the apparatus body, the cleaner 40 is disposed at a position in further front of the front end 45 of the LED head 22Bk, and the elastic body 41 does not contact the lens surface 49 and is not bent. In this embodiment, at that time, the tip height of the elastic body 41 from the bottom 75*b* is designed such that the tip of the elastic body 41 is made higher by a prescribed amount, namely 1 mm in this embodiment, than the lens surface 49 of the LED head 22Bk.

The state of the cleaner 40 at a time when the image forming unit 21Bk is inserted into and taken out from the restriction guide member 24Bk is described next. First, the state of the cleaner 40 at a time that the image forming unit 21Bk is taken out from the restriction guide member 24Bk where the printing operation is ended, is described.

Figure 12B:
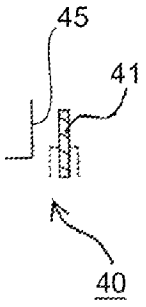
FIG. 12B is an enlarged view showing the cleaner shown in FIG. 12A.
Figure 12A:
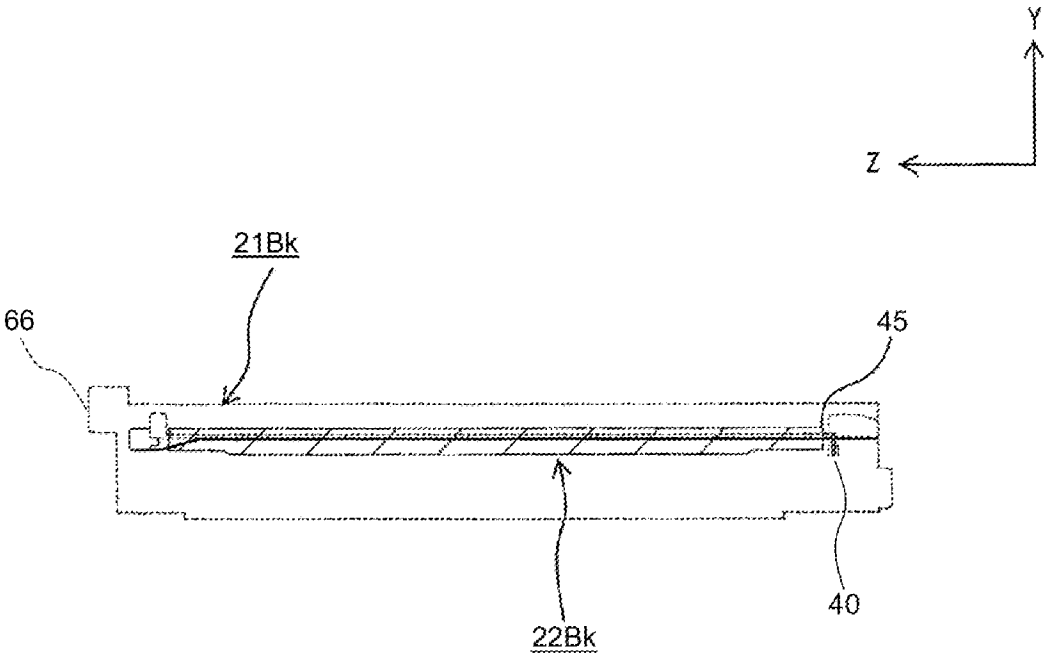
Figure 13B:
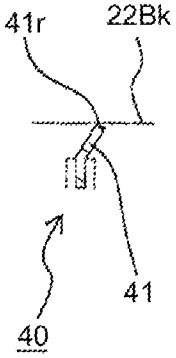
FIG. 13B is an enlarged view showing the cleaner shown in FIG. 13A.
Figure 13A:
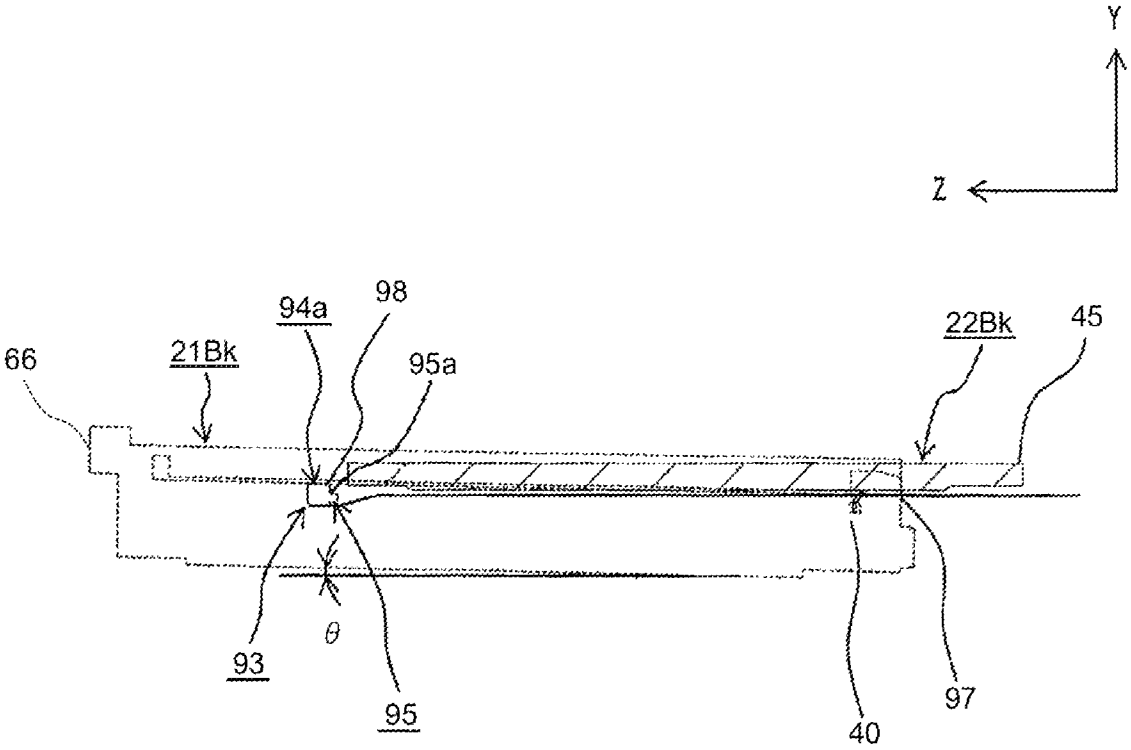
Figure 14:
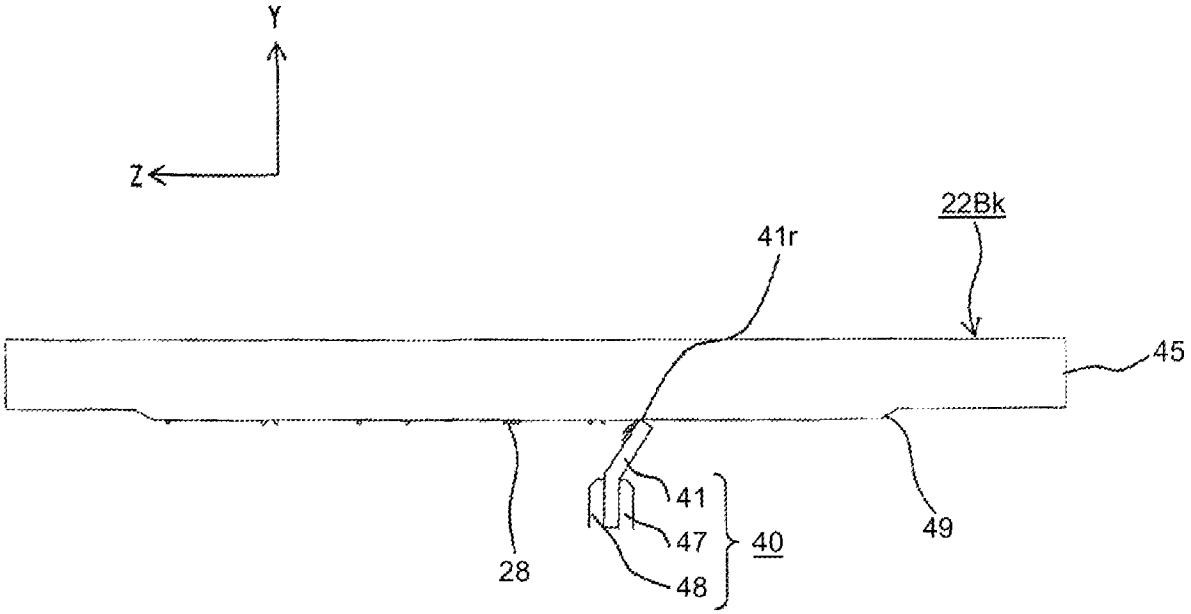
FIG. 14 is a schematic side view showing the cleaner cleaning the LED head according to the first embodiment of the invention.
Figure 15B:
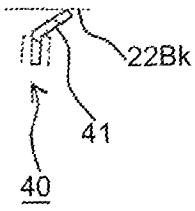
FIG. 15B is an enlarged view showing the cleaner shown in FIG. 15A.
Figure 15A:
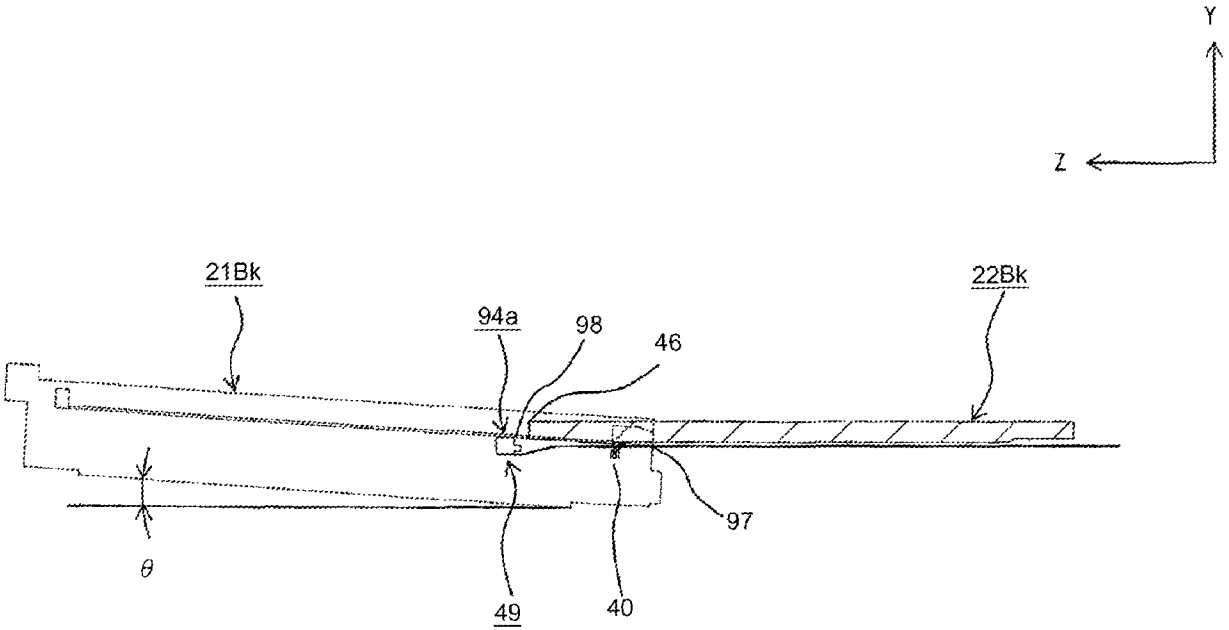

FIG. 12A is a first schematic side view showing the cleaner when the image forming unit is taken out from the restriction guide member according to the first embodiment of the invention while FIG. 12B is an enlarged view showing the cleaner shown in FIG. 12A; FIG. 13A is a second schematic side view showing the cleaner when the image forming unit is taken out from the restriction guide member according to the first embodiment of the invention while FIG. 13B is an enlarged view showing the cleaner shown in FIG. 13A; FIG. 14 is a schematic side view showing the cleaner cleaning the LED head according to the first embodiment of the invention; FIG. 15A is a third schematic side view showing the cleaner when the image forming unit is taken out from the restriction guide member according to the first embodiment of the invention while FIG. 15B is an enlarged view showing the cleaner shown in FIG. 15A.

Where the image forming unit 21Bk is attached to the apparatus body during the printing operation, the cleaner 40 is placed in further front of the front end 45 of the LED head 22Bk as shown in FIGS. 12A, 12B, so that the elastic body 41 does not contact the lens surface 49 and is not bent at all.

At that time, the receiving surfaces 79, 81 (see, FIG. 4) of the image forming unit 21Bk are made in contact with the top surface 95*a* of the projection 95 of the stopper members 92, 93 and with the supporting surfaces 90, 91 of the supporting edges 88, 89 (see, FIG. 1), respectively.

Subsequently, in a state that the printing operation is completed, if an operator grips the grip portion 68 (see, FIG. 5) to lift up the rear end 66 of the image forming unit 21Bk to pull the grip portion toward a near side (+Z-direction), the receiving surfaces 79, 81 (see, FIG. 4) slides over the step portion 96 as shown in FIGS. 13A, 13B. When the image forming unit 21Bk is started to be taken out from the restriction guide member 24Bk in this way, the front end 97 of the receiving surfaces 79, 81 is made in contact with the supporting surfaces 90, 91 of the supporting edges 88, 89, and the front end 98 of the top surface 94*a* of the stopper members 92, 93 is made in contact with the receiving surfaces 79, 81, thereby moving the image forming unit 21Bk backward.

At that time, the cleaner 40 is placed at a position at rear of the front end 45 of the LED head 22Bk and at rear of the front end 97 of the receiving surfaces 79, 81 (a position on a downstream side of the front end 97 in the +Z-direction (taken out direction of the image forming unit 21*bk*)), and the elastic body 41 contacts the lens surface 49 and is bent forward in the longitudinal direction of the image forming unit 21Bk, thereby rendering the second edge 41*r* contact the lens surface 49 and thereby rubbing the lens surface 49. Consequently, as shown in FIG. 14, the elastic body 41 wipes out the toner 28 attached to the lens surface 49 to clean up the LED head 22Bk. It is to be noted that the wiped toner 28 are moved together with the cleaner as attached around the second edge 41*r* of the elastic body 41.

During this operation, the insertion amount L of the image forming unit 21Bk is made smaller, and an amount taken out of the image forming unit 21Bk from the restriction guide member 24Bk, or a taking-out amount is made larger. The inclination θ of the image forming unit 21Bk is made larger, accordingly.

In this situation, the image forming unit 21Bk is moved pivotally around the front end 97 of the receiving surfaces 79, 81 as a center, so that a bending amount as a deforming amount of the elastic body 41 becomes larger as the inclination θ of the image forming unit 21Bk is made larger, and so that pushing force that the elastic body 41 pushes the lens surface 49 is made larger.

As shown in FIGS. 15A, 15B, when the taking-out operation of the image forming unit 21Bk from the restriction guide member 24Bk is almost completed, and when the cleaner 40 reaches a vicinity of the rear end 46 of the LED head 22Bk, the insertion amount L of the image forming unit 21Bk is further made smaller, and according to this, the taking out amount of the image forming unit 21Bk is further made larger, thereby making the inclination θ of the image forming unit 21Bk further larger. The bending amount of the elastic body 41 is made further larger, thereby making further larger the pushing force that the elastic body 41 pushes the lens surface 49.

A state of the cleaner 40 when the image forming unit 21Bk is inserted into the restriction guide member 24Bk is described next.

Figure 16B:
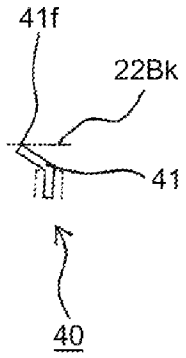
FIG. 16B is an enlarged view showing the cleaner shown in FIG. 16A.
Figure 16A:
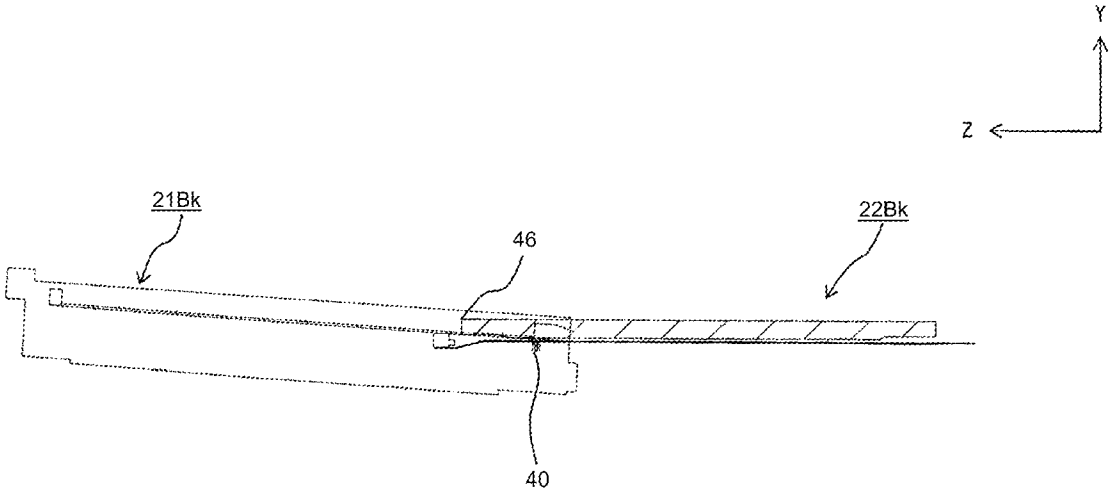
Figure 17B:
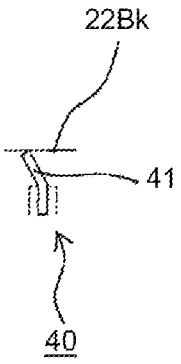
FIG. 17B is an enlarged view showing the cleaner shown in FIG. 17A.
Figure 17A:
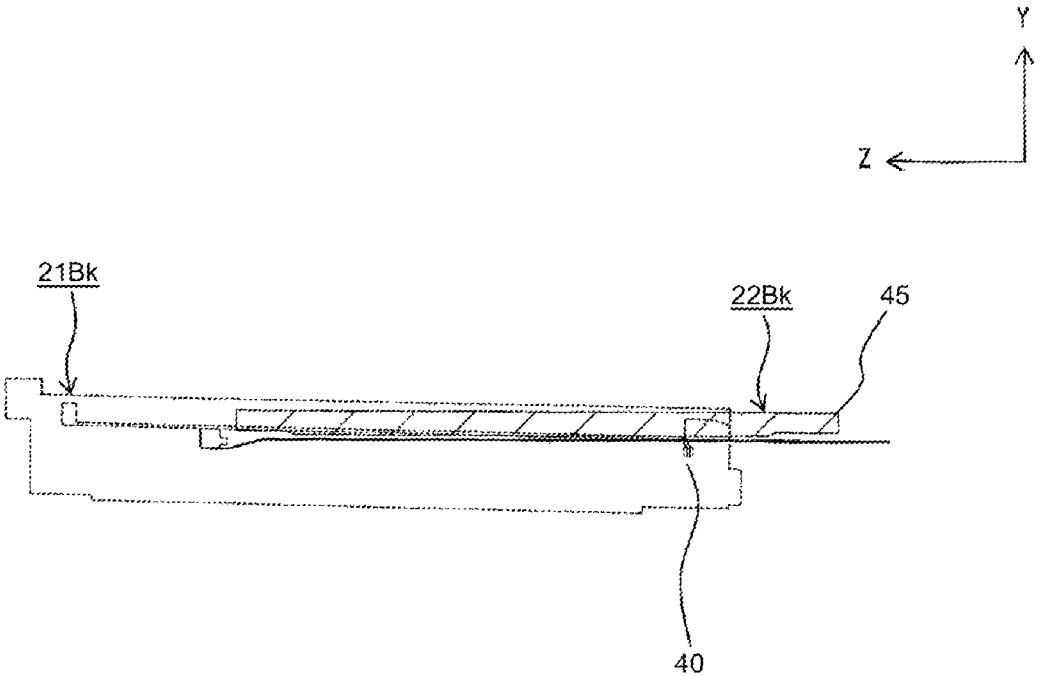
Figure 18B:
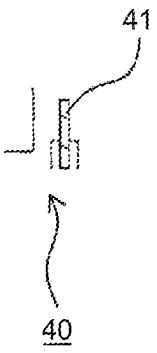
FIG. 18B is an enlarged view showing the cleaner shown in FIG. 18A.
Figure 18A:
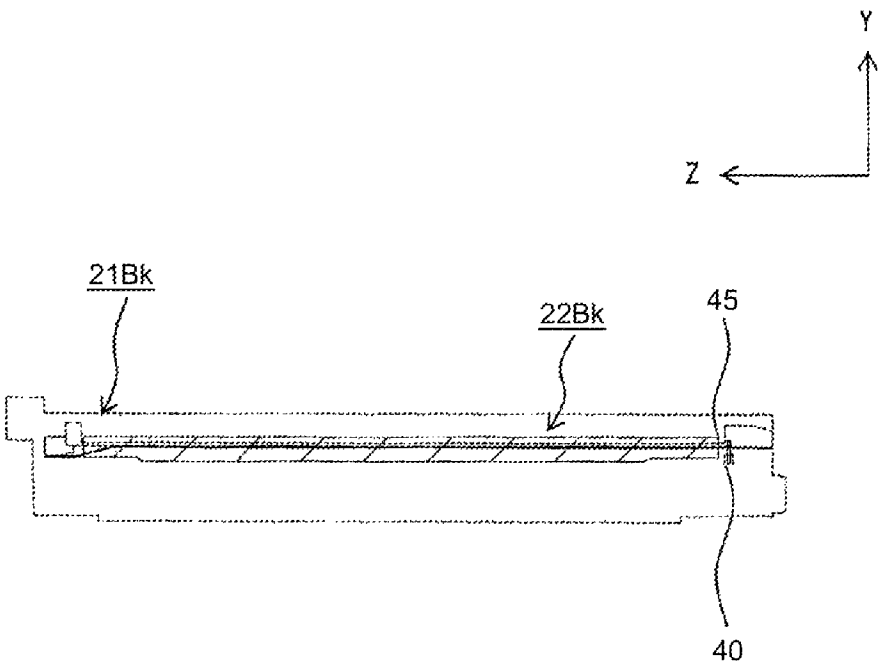

FIG. 16A is a first schematic side view showing the cleaner when the image forming unit is inserted into the restriction guide member according to the first embodiment of the invention, while FIG. 16B is an enlarged view showing the cleaner shown in FIG. 16A; FIG. 17A is a second schematic side view showing the cleaner when the image forming unit is inserted into the restriction guide member according to the first embodiment of the invention, while FIG. 17B is an enlarged view showing the cleaner shown in FIG. 17A; FIG. 18A is a third schematic side view showing the cleaner when the image forming unit is inserted into the restriction guide member according to the first embodiment of the invention, while FIG. 18B is an enlarged view showing the cleaner shown in FIG. 18A.

As shown in FIGS. 16A, 16B, when an insertion of the image forming unit 24Bk into the restriction guide member 24Bk begins, the front end 97 of the receiving surfaces 79, 81 (see, FIG. 4) is made in contact with the supporting surfaces 90, 91 of the supporting edges 88, 89 (see, FIG. 1), and the front end 98 of the top surface 94*a* of the stopper members 92, 93 is made in contact with the receiving surfaces 79, 81, thereby moving forward the image forming unit 21Bk.

At that time, the cleaner 40 is placed at a position in further front of the rear end 46 of the LED head 22Bk.

As proceeding of the image forming unit 21Bk, the elastic body 41 contacts the lens surface 49 and is bent backward in the longitudinal direction of the image forming unit 21Bk, and the first edge 41*f* contacts the lens surface 49, thereby rubbing the lens surface 49.

During this operation, the insertion amount L of the image forming unit 21Bk is made larger, and the taking-out amount is made smaller. According to this, the inclination θ of the image forming unit 21Bk is made smaller. As shown in FIGS. 17A, 17B, the bending amount of the elastic body 41 becomes smaller.

Subsequently, where the image forming unit 21Bk is made to move forward, and where, as shown in FIGS. 18A, 18B, the insertion of the image forming unit 21Bk into the restriction guide member 24Bk is completed, the cleaner 40 is placed in further front of the front end 45 of the LED head 22Bk, so that the elastic body 41 comes not in contact with the lens surface 49 and is not bent.

As described above, the LED head 22Bk is cleaned up with the second edge 41*r* when the image forming unit 21Bk is taken out from the restriction guide member 24Bk, so that the LED head 22Bk is not cleaned up with the first edge 41*f*.

That is, the elastic body 41 is bent forward in the longitudinal direction of the image forming unit 21Bk upon contacting the lens surface 49 when the image forming unit 21Bk is taken out from the restriction guide member 24Bk, so that the second edge 41*r* contacts the image forming unit 21Bk to rub the lens surface 49. To the contrary, when the image forming unit 21Bk is inserted into the restriction guide member 24Bk, the elastic body 41 is bent backward in the longitudinal direction of the image forming unit 21Bk upon contacting the lens surface 49, and the first edge 41*f* contacts the lens surface 49, thereby rubbing the lens surface 49. Accordingly, the toner 28 is wiped out by the second edge 41*r* when the image forming unit 21Bk is taken out from the restriction guide member 24Bk, and because the toner 28 attached near the second edge 41*r* may not contact the lens surface 49, the toner 28 may not attach to the lens surface 49 again.

In operation of the cleaner 40, for example, where the toner 28 is attached to the lens surface 41 of the LED head 22Bk during the printing operation, and where the operator stops the printing operation and opens the exterior cover 37 (see, FIG. 2) in a case that smears or the like occur on images on the paper, the lifting mechanism is activated to move the restriction guide member 24Bk to the image forming unit escaping portion, and the image forming unit 21Bk supported by the restriction guide member 24Bk is separated adequately from the transfer belt 13.

In association with the operation of the lifting mechanism, the LED head 22Bk is placed at the non-exposure position, and is separated from the image forming unit 21Bk, thereby allowing the image forming unit 21Bk inserting into and taken out from the restriction guide member 24Bk.

If the operator grips the grip portion 68 (see, FIG. 5) to move the image forming unit 21Bk upward (+Y-direction), the rear end surface of the projecting portions 78, 80 (see, FIG. 4) is moved above the step portion 96, thereby releasing the restriction to the image forming unit 21Bk by the restriction guide member 24Bk.

Subsequently, if the operator pulls the image forming unit 21Bk toward a near side, the front end 97 of the receiving surfaces 79, 81 is made to contact the supporting surfaces 90, 91, and the front end 98 of the top surface 94*a* of the stopper members 92, 93 are made to contact the receiving surfaces 79, 81, thereby moving the image forming unit 21Bk backward.

The elastic body 41 of the cleaner 40 contacts the lens surface 49 and is bent forward in the longitudinal direction of the image forming unit 21Bk, and the second edge 41*r* contacts the lens surface 49 to rub the lens surface 49. Consequently, the toner 28 attached to the lens surface 49 is wiped out to clean up the LED head 22Bk.

As described above, in this embodiment, when the image forming unit 21Bk is inserted into and taken out from the restriction guide member 24Bk, the image forming unit 21Bk is inclined according to the inclination θ to a horizontal plane of the image forming unit 21Bk to change the pushing force that the elastic body 41 pushes the lens surface 49. A relationship between the inclination θ to the horizontal plane of the image forming unit 21Bk and the pushing force that the elastic body 41 pushes the lens surface 49 is described herein.

Figure 19:
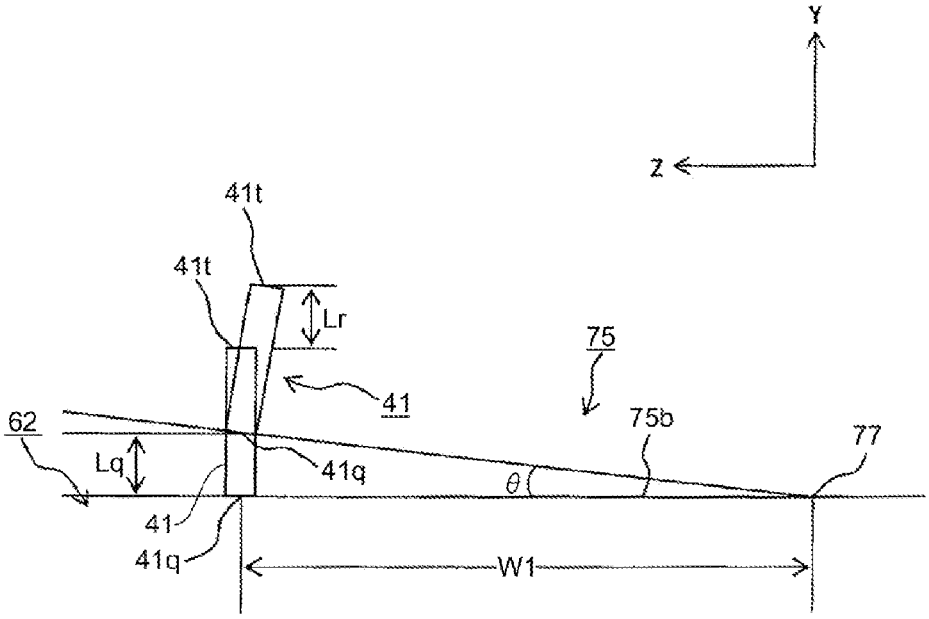
FIG. 19 is a schematic view showing a relationship between inclination of the image forming unit and pushing force according to the first embodiment of the invention.
Figure 20:
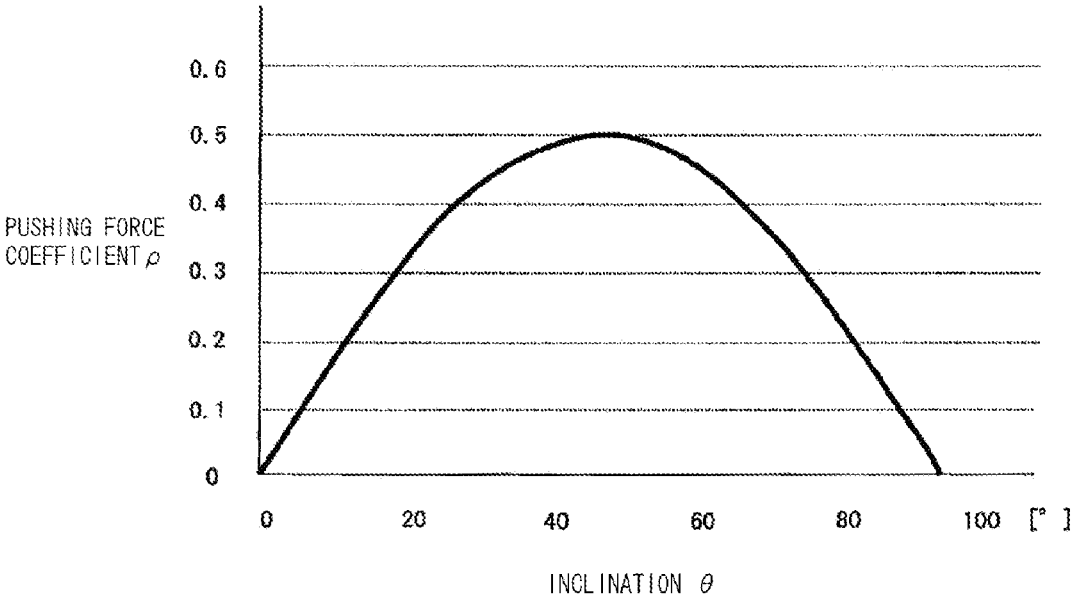
FIG. 20 is a graph showing a relationship between inclination of the image forming unit and pushing force coefficient according to the first embodiment of the invention.

FIG. 19 is a schematic view showing a relationship between inclination of the image forming unit and pushing force according to the first embodiment of the invention; FIG. 20 is a graph showing a relationship between inclination of the image forming unit and pushing force coefficient according to the first embodiment of the invention. In FIG. 20, an abscissa represents inclination θ of the image forming unit 21Bk, whereas an ordinate represents pushing force coefficient ρ.

In FIG. 19, the upper cover 62 is formed with the groove portion 75 having the bottom 75*b*. The elastic body 41 is provided as projecting from the bottom 75*b* of the groove portion 75. A pivotal center 77 is formed, as a center point that the bottom 75*b* of the groove portion 75 is pivotally moved, according to pivotal movements of the image forming unit 24Bk around the front end 97 (see, FIG. 9) of the receiving surfaces 79, 81 as a center. Numeral W1 is a distance from the pivotal center 77 to a point at which the elastic body 41 is attached, or namely to a lower end 41*q* of the elastic body 41.

Where the image forming unit 21Bk is inclined with the inclination θ with respect to the horizontal plane, the bottom 75*b* of the groove portion 75 is pivotally moved around the pivotal center 77, and is inclined with the inclination θ with respect to the horizontal plane. The lower end 41*q* of the elastic body 41 is moved upward (+Y direction), in comparison with a situation that the image forming unit 21Bk is provided as extending horizontally, by a movement amount Lq.

$$Lq=W1 \sin \theta$$

The elastic body 41 is also moved pivotally around the pivotal center 77 as a center and inclined with the inclination θ, so that a tip 41*t* of the elastic body 41 is moved upward by a movement amount Lr.

$$Lr=W1 \sin \theta \cos \theta$$

Pushing force proportional to the movement amount Lr is made to occur.

Where the value sin θ cos θ is set as the pushing force coefficient ρ, as shown in FIG. 20, the pushing force coefficient ρ is made larger as the inclination θ is made larger in a range of 0 degree≤θ≤45 degrees, thereby making the pushing force larger. The pushing force coefficient ρ is smaller as the inclination θ is made larger in a range of 45 degrees<θ, thereby making the pushing force smaller.

A change rate Δp of the pushing force coefficient ρ is made large where the inclination θ is in a range of 0 degree≤θ≤25 degrees, and is made small where the inclination θ is in a range of 25 degrees<θ≤45 degrees. In this embodiment, therefore, the inclination θ is preferably set to the range of 0 degree≤θ≤45 degrees, and more preferably set to the range of 0 degree≤θ≤25 degrees.

In this embodiment, thus, even where toner 28 is attached to the lens surface 49 of the LED head 22Bk during the printing operation to generate smears or like on images on the paper, the cleaner 40 cleans up the LED head 22Bk when the image forming unit 21Bk is taken out from the restriction guide member 24Bk, so that the lens excellently focuses rays accompanied with light emissions of the LED elements to surely radiate the surface of the photosensitive drum 25 and to form electrostatic latent images accurately. The image forming apparatus therefore can prevent image quality from impaired.

As the taken out amount of the image forming unit 21Bk becomes larger, the inclination θ of the image forming unit 21Bk becomes larger to make larger the pushing force that the elastic body 41 pushes the lens surface 49, so that the toner 28 wiped out with the second edge 41*r* is prevented from passing through a gap between the second edge 41*r* and the lens surface 49. As a result, the LED head 22Bk is surely cleaned up.

Furthermore, the pushing force may not become large until that the amount of the toner 28 wiped out and attached near the second edge 41*r* becomes so much, so that wearing of the second edge 41*r* occurring due to rubbing on the lens surface 49 can be prevented. The cleaner 40 is therefore made highly durable.

Next, a second embodiment of the invention is described. It is to be noted that structures and elements which are the same as those in the first embodiment, are assigned with the same reference numbers as those in the first embodiment for the sake of brevity. The advantages brought from the same structures are also omitted from the description in this embodiment or the sake of brevity.

Figure 21:
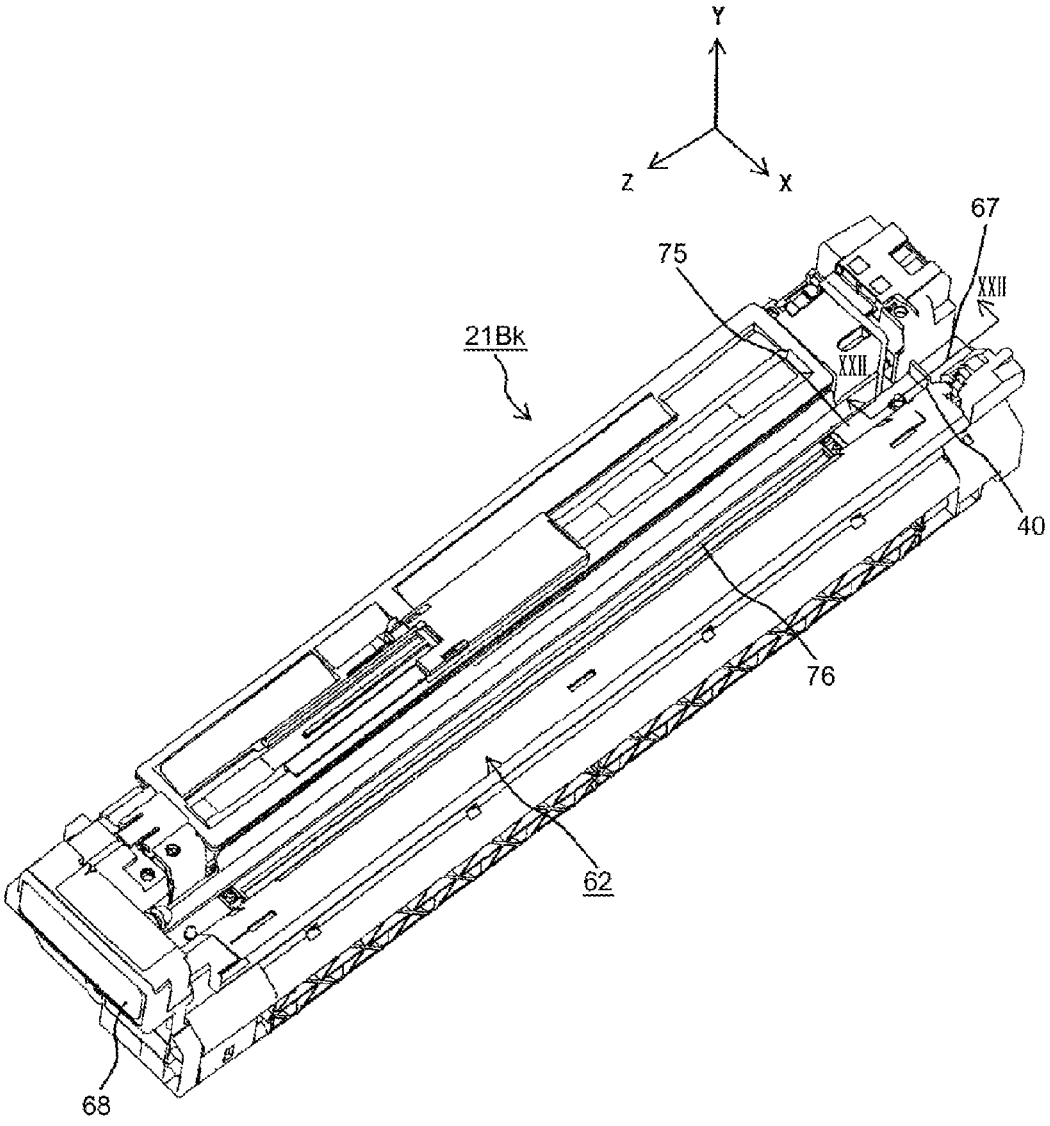
FIG. 21 is a perspective view showing an image forming unit and a restriction guide member with a cleaner in an installation state according to a second embodiment of the invention.
Figure 22:
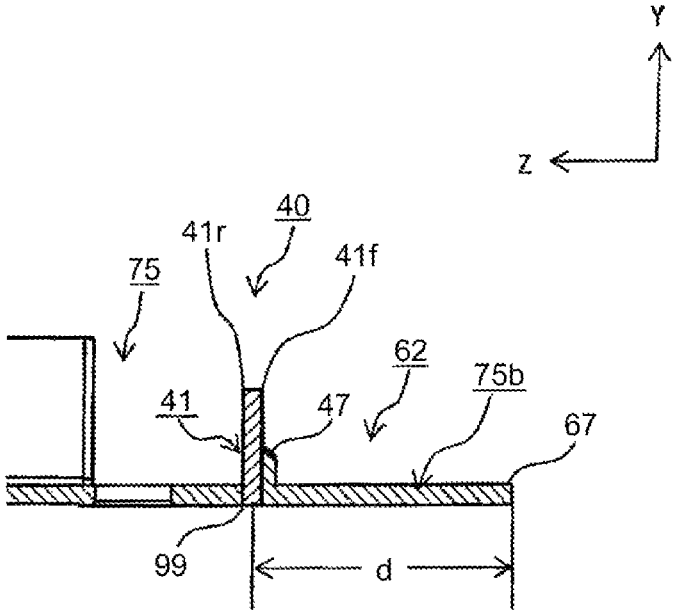
FIG. 22 is a cross section of the cleaner and vicinity thereof taken along XXII-XXII line in FIG. 21.

FIG. 21 is a perspective view showing an image forming unit and a restriction guide member with a cleaner in an installation state according to a second embodiment of the invention; FIG. 22 is a cross section of the cleaner and vicinity thereof taken along XXII-XXII line in FIG. 21.

As shown in FIGS. 21, 22, the cleaner 40 is disposed at rear of the front end 67 of the image forming unit 21Bk only by distance d.

The cleaner 40 is disposed as projecting toward the lens surface 49 (see, FIG. 7) of the LED head 22Bk as an exposure device from the bottom 75*b* of the groove portion 75. The cleaner 40 is made of a plate shaped elastic body 41 having a rectangular shape secured as a lower end thereof is embedded to a hole 99 formed at the bottom 75*b* of the groove portion 75, and of a holder 47 formed on a front end side of the elastic body 41 in the longitudinal direction of the image forming unit 21Bk and formed as projecting from the bottom 75*b* of the groove portion 75 in a united body with the bottom 75*b* for holding the lower portion of the elastic body 41. The elastic body 41 has a thickness of 1 mm or more and 3 mm or less, 2 mm in this embodiment, and is made of a sponge material of a urethane rubber. A first edge 41*f* is formed at a top end of a front surface of the elastic body 41 in the longitudinal direction of the image forming unit 21Bk, whereas a second edge 41*r* is formed at a top end of a rear surface of the elastic body 41. When the image forming unit 21Bk is taken out from the restriction guide member 24Bk as a unit supporting member, the elastic body 41 is made to contact the lens surface 49, thereby bending the elastic body 41 forward in the longitudinal direction of the image forming unit 21Bk, and rendering the second edge 41*r* in contact with the lens surface 49 to rub the lens surface 49.

Accordingly, where the toner 28 (see, FIG. 4) as a developer is attached to the lens surface 49 during, e.g., printing operation, and where smears or the like occur on the images on the paper as a medium, the toner 28 attached to the lens surface 49 can be wiped out to clean up the LED head 22Bk.

When the image forming unit 21Bk is inserted into the restriction guide member 24Bk, the elastic body 41 contacts the lens surface 49, and is bent backward in the longitudinal direction of the image forming unit 21Bk, thereby rendering the first edge 41*f* come in contact with the lens surface 49 to rub the lens surface 49. In this situation, the toner 28 attached to the lens surface 49 is already wiped out when the image forming unit 21Bk is taken out from the restriction guide member 24Bk, thereby preventing the first edge 41*f* from becoming dusty. The first edge 41*f* may not make the lens surface 49 dusty.

Because the holder 47 is disposed on the front surface side of the elastic body 41, and because the holder 47 holds the elastic body 41, the elastic body 41 is bent in the same bending amount as that in the first embodiment and pushes the lens surface 49 with the same pushing force. To the contrary, because no holder is provided on a rear side of the elastic body 41, when the image forming unit 21Bk is inserted into the restriction guide member 24Bk, the elastic body 41 is bend in an amount larger than that in the first embodiment and therefore pushes the lens surface 49 with smaller pushing force.

Accordingly, the operator can insert the image forming unit 21Bk into the restriction guide member 24Bk smoothly, and can attach the image forming unit 21Bk to the apparatus body accurately. Rubbing the lens surface 49 done by the elastic body 41 can prevent the second edge 41*r* from wearing quickly, so that the cleaner 40 can be made highly durable.

Next, the state of the cleaner 40 when the image forming unit 21Bk is inserted into and taken out from the restriction guide member 24Bk is described.

First, while the printing operation is completed, the state of the cleaner 40 where the image forming unit 21Bk is taken out from the restriction guide member 24Bk, is described.

Figure 23B:
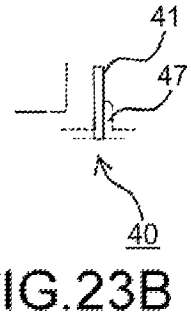
FIG. 23B is an enlarged view showing the cleaner shown in FIG. 23A.
Figure 23A:
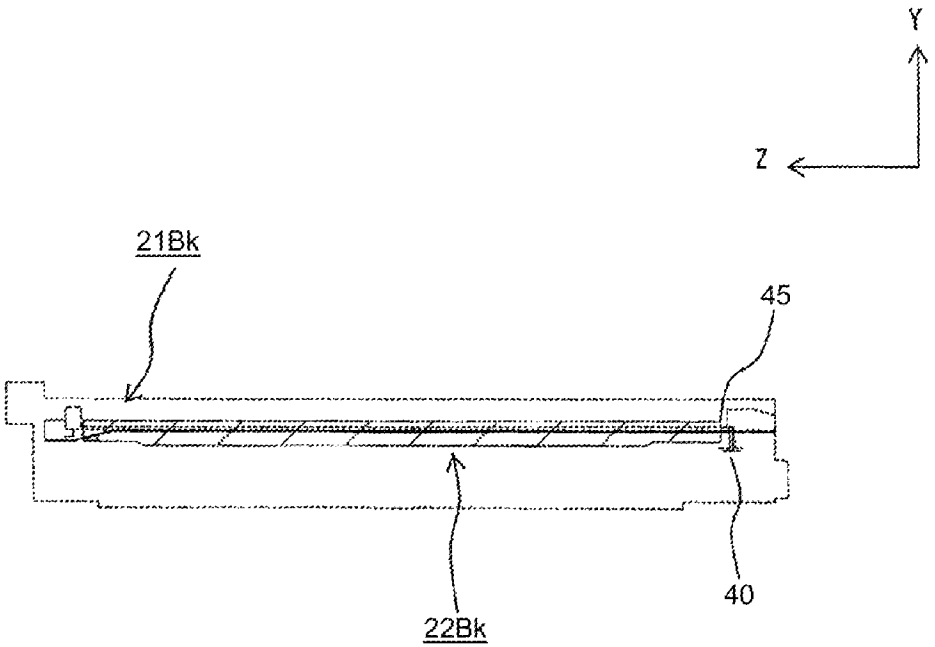
Figure 24B:
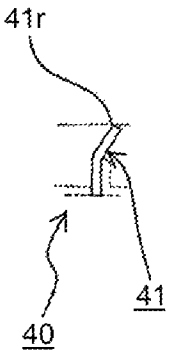
FIG. 24B is an enlarged view showing the cleaner shown in FIG. 24A.
Figure 24A:
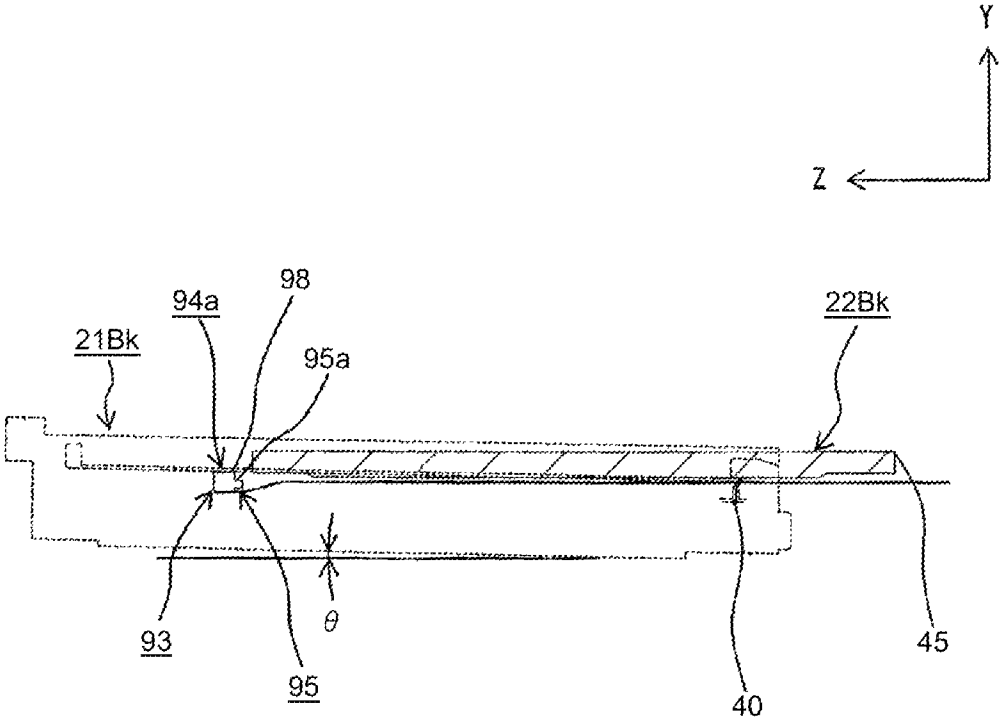
Figure 25B:
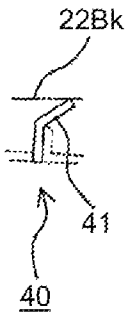
FIG. 25B is an enlarged view showing the cleaner shown in FIG. 25A.
Figure 25A:
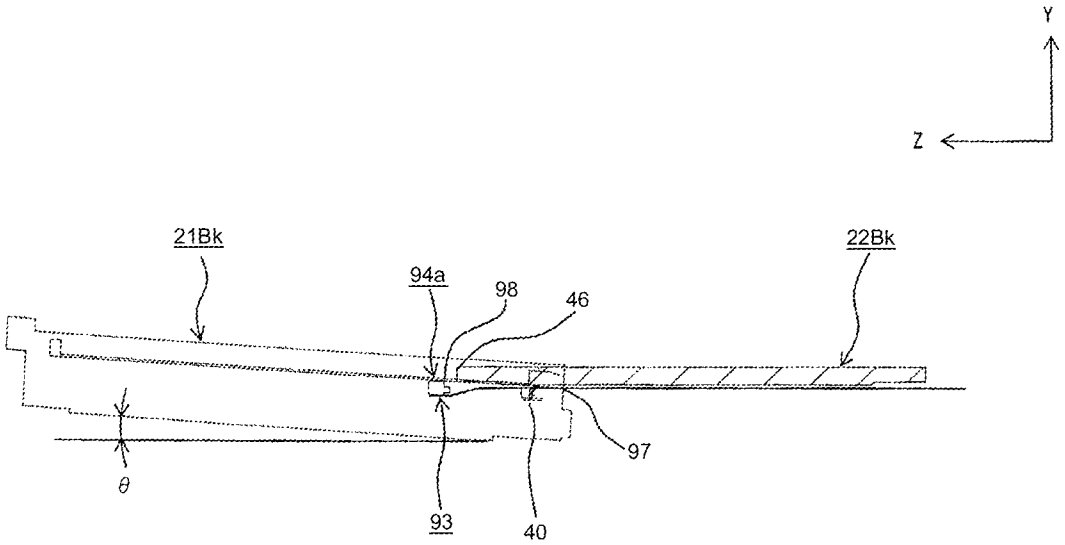

FIG. 23A is a first schematic side view showing the cleaner when the image forming unit is taken out from the restriction guide member according to the second embodiment of the invention, while FIG. 23B is an enlarged view showing the cleaner shown in FIG. 23A; FIG. 24A is a second schematic side view showing the cleaner when the image forming unit is taken out from the restriction guide member according to the second embodiment of the invention while FIG. 24B is an enlarged view showing the cleaner shown in FIG. 24A; FIG. 25A is a third schematic side view showing the cleaner when the image forming unit is taken out from the restriction guide member according to the second embodiment of the invention while FIG. 25B is an enlarged view showing the cleaner shown in FIG. 25A.

Where the image forming unit 21Bk is attached to the apparatus body during the printing operation, the cleaner 40 is placed at a position in further front of the front end 45 of the LED head 22Bk as shown in FIGS. 23A, 23B, so that the elastic body 41 does not contact the lens surface 49 and is not bent at all.

The receiving surfaces 79, 81 (see, FIG. 4) as a supported portions of the image forming unit 21Bk are made in contact with the top surface 95*a* of the projection 95 of the stopper members 92, 93 (see, FIG. 1) and with the supporting surfaces 90, 91 of the supporting edges 88, 89.

As shown in FIG. 24, while the printing operation is completed, upon beginning of taking out operation of the image forming unit 21Bk from the restriction guide member 24Bk, the front end 97 of the receiving surfaces 79, 81 is made to contact with the supporting surfaces 90, 91, and the front end 98 of the top surface 94*a* of the stopper members 92, 93 is made to contact with the receiving surfaces 79, 81, thereby moving backward the image forming unit 21Bk.

The cleaner 40 at that time is placed at a position at rear of the front end 45 of the LED head 22Bk and at rear of the front end 97 of the receiving surfaces 79, 81, thereby rendering the elastic body 41 in contact with the lens surface 49 and bent forward in the longitudinal direction of the image forming unit 21Bk, so that the second edge 41*r* is made to contact with the lens surface 49 and rubs the lens surface 49. As a result, the elastic body 41 wipes out the toner attached to the lens surface 49, thereby cleaning up the LED head 22Bk.

During this operation, the insertion amount L of the image forming unit 21Bk is made smaller, and the taking-out amount is made larger. According to this operation, the inclination θ of the image forming unit 21Bk is made lager, so that the bending amount of the elastic body 41 is made larger while the pushing force that the elastic body 41 pushes the lens surface 49 is made larger.

As shown in FIG. 25, where the taking out operation of the image forming unit 21Bk from the restriction guide member 24Bk is almost completed, and where the cleaner 40 reaches the vicinity of the rear end 46 of the LED head 22Bk, the insertion amount L of the image forming unit 21Bk is made further smaller, and the taking-out amount of the image forming unit 21Bk is accordingly made further larger, thereby making the inclination θ of the image forming unit 21Bk further larger. The bending amount of the elastic body 41 is further made larger, and the pushing force that the elastic body 41 pushes lens surface 49 is made further larger.

Next, the state of the cleaner 40 at a time when the image forming unit 21Bk is inserted into the restriction guide member 24Bk, is described.

Figure 26B:
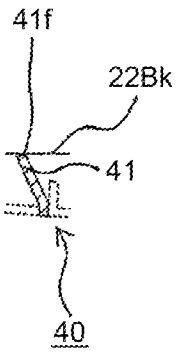
FIG. 26B is an enlarged view showing the cleaner shown in FIG. 26A.
Figure 26A:
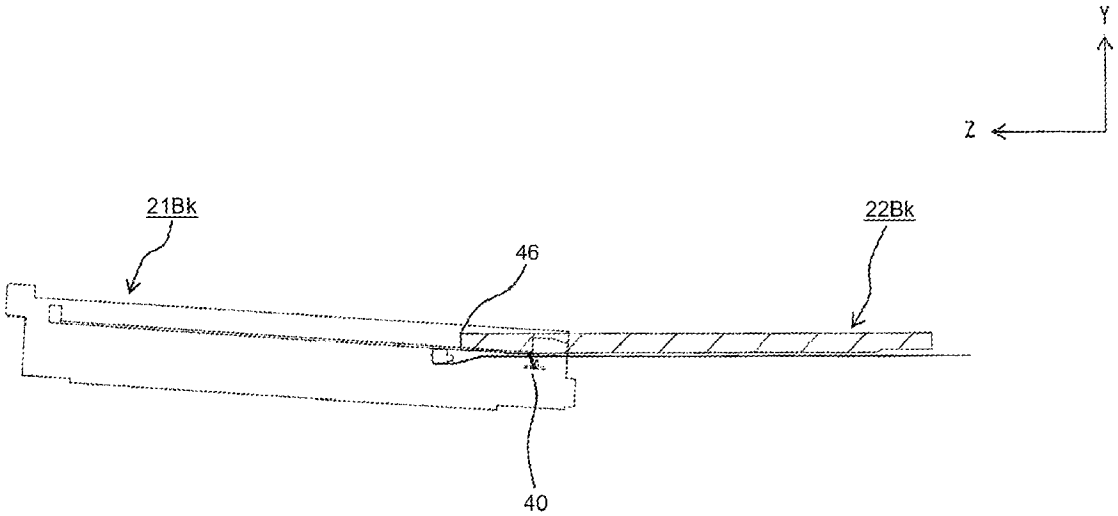
Figure 27B:
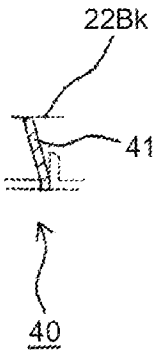
FIG. 27B is an enlarged view showing the cleaner shown in FIG. 27A.
Figure 27A:
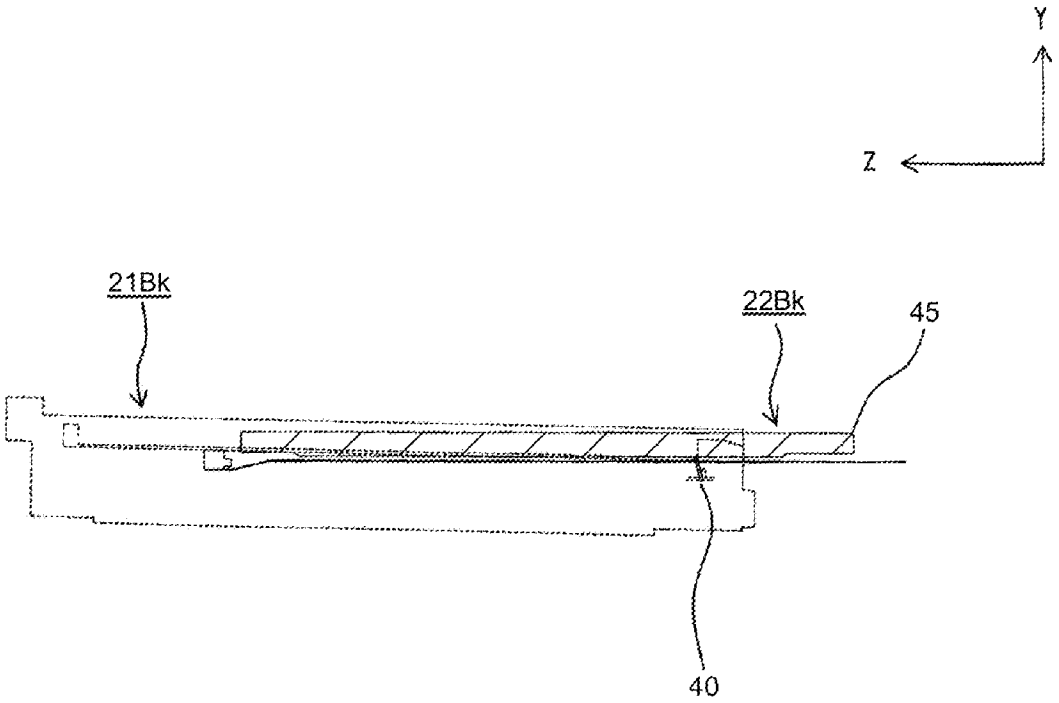
Figure 28B:
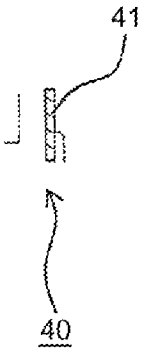
FIG. 28B is an enlarged view showing the cleaner shown in FIG. 28A.
Figure 28A:
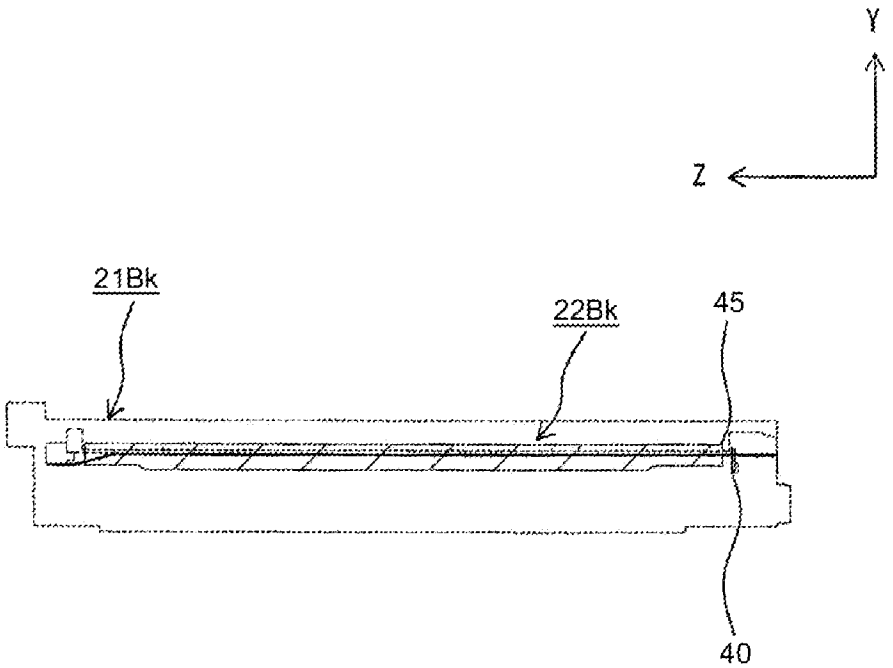

FIG. 26A is a first schematic side view showing the cleaner when the image forming unit is inserted into the restriction guide member according to the second embodiment of the invention while FIG. 26B is an enlarged view showing the cleaner shown in FIG. 26A; FIG. 27A is a second schematic side view showing the cleaner when the image forming unit is inserted into the restriction guide member according to the second embodiment of the invention, while FIG. 27B is an enlarged view showing the cleaner shown in FIG. 27A; FIG. 28A is a third schematic side view showing the cleaner when the image forming unit is inserted into the restriction guide member according to the second embodiment of the invention, while FIG. 28B is an enlarged view showing the cleaner shown in FIG. 28A.

When the insertion of the image forming unit 21Bk into the restriction guide member 24Bk is started, the front end 97 of the receiving surfaces 79, 81 is made to contact with the supporting surfaces 90, 91 of the supporting edges 88, 89, and the image forming unit 21Bk is moved forward.

As shown in FIGS. 26A, 26B, the cleaner 40 is placed at a position in further front of the rear end 46 of the LED head 22Bk, and the elastic body 41 comes in contact with the lens surface 49 according to the forward motion of the image forming unit 21Bk and is bent backward in the longitudinal direction of the image forming unit 21Bk, thereby rubbing the lens surface 49 with the first edge 41*f*.

During this operation, the insertion amount L of the image forming unit 21Bk is made larger, and the taking-out amount L is made smaller. According to this, the inclination θ of the image forming unit 21Bk is made smaller. As shown in FIGS. 27A, 27B, the bending amount of the elastic body 41 is thus made smaller.

Subsequently the image forming unit 21Bk is moved further forward, and as shown in FIGS. 28A, 28B, when the insertion of the image forming unit 21Bk into the restriction guide member 24Bk is almost completed, the cleaner 40 is placed at a position in further front of the front end 45 of the LED head 22Bk, and the elastic body does not contact the lens surface 49, and is not bent at all.

As described above, because no holder is provided on a back side of the elastic body 41, when the image forming unit 21Bk is inserted into the restriction guide member 24Bk, a free length of the elastic body 41 is made longer, and the elastic body 41 is bent in a larger bending amount than that in the first embodiment.

Thus, with this embodiment, when the image forming unit 21Bk is inserted into the restriction guide member 24Bk, the free length of the elastic body 41 is made longer, and is bend in the larger bending amount than that in the first embodiment, so that the pushing force that the elastic body 41 pushes the lens surface 49 cannot be larger.

Accordingly, the operator can smoothly insert the image forming unit 21Bk into the restriction guide member 24Bk, so that the image forming unit 21Bk can be mounted to the apparatus body accurately. Because the elastic body 41 rubs the lens surface 49 with preventing the second edge 41*r* from wearing, the cleaner 40 can be made more durable.

In the above embodiments, although the printer 10 is described, the invention is applicable to image forming apparatuses such as, e.g., photocopiers, facsimile machines, and MFPs (Multi-Function Peripherals).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An image forming apparatus comprising:

an image forming unit having an image carrier and being arranged detachably to an apparatus body;

a unit supporting member provided to the apparatus body, for supporting the image forming unit in a detachably inserting manner; and an exposure device, arranged in facing the image carrier while the image forming unit is attached to the apparatus body, for exposing a surface of the image carrier, wherein the unit supporting member includes a first contact supporting portion for supporting the image forming unit, and a second contact supporting portion disposed on a downstream side of the first contact supporting portion in a taking out direction of the image forming unit from the unit supporting member for forming a step portion projecting from a level of the first contact supporting portion, and wherein the image forming unit includes a first contact supported portion contacting and being supported by the first contact supporting portion, a second contact supported portion contacting and being supported by the second contact supporting portion, and a cleaner for cleaning the exposure device when the image forming unit is taken out from the unit supporting member.

2. The image forming apparatus according to claim 1, wherein the first and second contact supported portions are formed at a supported portion formed in extending in a longitudinal direction of the image forming unit, and wherein the supported portion slides over the step portion when image forming unit is taken out from the unit supporting member.

3. The image forming apparatus according to claim 1, wherein the cleaner is disposed on a downstream side of the first contact supported portion in the taking out direction of the image forming unit.

4. The image forming apparatus according to claim 1, wherein the cleaner makes cleaning on the exposure device by contacting the exposure device.

5. The image forming apparatus according to claim 1, wherein the cleaner has a first edge contacting the exposure device when the image forming unit is taken out from the unit supporting member, and a second edge contacting the exposure device when the image forming unit is inserted into the unit supporting member.

6. The image forming apparatus according to claim 1, further comprising a first supporting portion extending in a longitudinal direction of the unit support member, wherein the first contact supporting portion is formed at the first supporting portion.

7. The image forming apparatus according to claim 1, further comprising a stopper member attached to an end in a downstream side of the unit support member in the taking out direction of the image forming unit, for preventing the image forming unit from detaching from the unit support member, wherein the second contact supporting portion is formed at a top surface of the stopper member.

8. The image forming apparatus according to claim 1, wherein the second contact supporting portion forms the step portion as projecting from the first contact supporting portion in a direction such that the cleaner comes closer to the image forming unit.

9. The image forming apparatus according to claim 1, wherein the first contact supporting portion includes a supporting surface, and wherein the image forming unit is inclined in a prescribed angle toward a direction such that a lower end of the image forming unit in the taking out direction is separated more from the support surface than an upper end thereof where the first contact supporting portion is in contact with the first contact supported portion and where the second contact supporting portion is in contact with the second contact supported portion.

10. The image forming apparatus according to claim 9, wherein the prescribed angle is defined as angle $\theta$, and wherein the angle $\theta$ is equal to or less than 45 degrees during a process that the image forming unit is taken out from the apparatus body.

11. The image forming apparatus according to claim 1, wherein the cleaner is formed of a plate shaped elastic body extending in a direction substantially perpendicular to the taking out direction where the image forming unit is attached to the apparatus body.

12. The image forming apparatus according to claim 1, wherein the cleaner is formed of a plate shaped elastic body held on only one side with a holder extending a proximal end of the plate shaped elastic body.

13. The image forming apparatus according to claim 1, wherein the exposure device is an LED head having a lens surface extending in a longitudinal direction thereof, which is substantially the same as the taking out direction of the image forming unit.

14. An image forming apparatus comprising:

an image forming unit having an image carrier and being arranged detachably to an apparatus body;

a unit supporting member provided to the apparatus body, for supporting the image forming unit in a detachably inserting manner; and an exposure device, arranged in facing the image carrier while the image forming unit is attached to the apparatus body, for exposing a surface of the image carrier, and a cleaner for cleaning the exposure device when the image forming unit is taken out from the apparatus body, wherein, during a process that the image forming unit is taken out from the apparatus body, the cleaner contacts the exposure device with contact pressure increasing as the image forming unit is further taken out from the apparatus body.

15. The image forming apparatus according to claim 14, wherein the cleaner is formed of a plate shaped elastic body extending in a direction substantially perpendicular to the taking out direction where the image forming unit is attached to the apparatus body.

* * * * *